US008303772B2

(12) United States Patent
Li et al.

(10) Patent No.: US 8,303,772 B2
(45) Date of Patent: Nov. 6, 2012

(54) METHOD FOR PREPARING A GRASS-TYPE UNBLEACHED PAPER PRODUCT

(75) Inventors: Hongfa Li, Liaocheng (CN); Mingxin Song, Liaocheng (CN); Jihui Yang, Liaocheng (CN); Yanjin Bi, Liaocheng (CN); Jinxiang Xu, Liaocheng (CN)

(73) Assignee: Shangdong Fuyin Paper & Environmental Protection Technology Co., Ltd., Shangdong (CN)

( * ) Notice: Subject to any disclaimer, the term of this patent is extended or adjusted under 35 U.S.C. 154(b) by 94 days.

(21) Appl. No.: 12/811,655

(22) PCT Filed: Jul. 25, 2008

(86) PCT No.: PCT/CN2008/001380

§ 371 (c)(1),
(2), (4) Date: Jul. 2, 2010

(87) PCT Pub. No.: WO2009/070955

PCT Pub. Date: Jun. 11, 2009

(65) Prior Publication Data

US 2011/0061825 A1 Mar. 17, 2011

(30) Foreign Application Priority Data

Dec. 5, 2007 (CN) ..... 2007 1 03002085

(51) Int. Cl.

| | |
|---|---|
| ***D21H 11/12*** | (2006.01) |
| ***D21C 3/12*** | (2006.01) |
| ***D21C 9/02*** | (2006.01) |
| ***D21C 3/14*** | (2006.01) |

(52) U.S. Cl. ..... 162/148; 162/29; 162/55; 162/56; 162/60; 162/65; 162/82; 162/83; 162/86; 162/97; 162/99

(58) Field of Classification Search ..... 162/13, 162/23–24, 56, 60, 63, 65, 70, 90–91, 97, 162/99, 141, 148–149; 241/18, 21
See application file for complete search history.

(56) References Cited

U.S. PATENT DOCUMENTS

| | | | | |
|---|---|---|---|---|
| 1,347,979 | A * | 7/1920 | Werner | 162/17 |
| 1,534,236 | A * | 4/1925 | Adam et al. | 435/278 |
| 2,164,192 | A * | 6/1939 | Marcham et al. | 162/11 |
| 2,388,592 | A * | 11/1945 | Asplund et al. | 162/23 |
| 2,662,012 | A * | 12/1953 | Teunissen | 162/82 |
| 2,686,120 | A * | 8/1954 | Marshall | 162/14 |
| 4,040,899 | A * | 8/1977 | Emerson | 162/13 |
| 4,384,920 | A * | 5/1983 | Markham et al. | 162/19 |
| 5,650,111 | A * | 7/1997 | Gasland | 264/175 |
| 6,923,887 | B2 * | 8/2005 | Pan | 162/6 |
| 2001/0023749 | A1 * | 9/2001 | Nay et al. | 162/21 |
| 2003/0070779 | A1 * | 4/2003 | Bransby | 162/97 |
| 2003/0213568 | A1 * | 11/2003 | Wester et al. | 162/7 |
| 2003/0213569 | A1 * | 11/2003 | Wester et al. | 162/18 |
| 2003/0213570 | A1 * | 11/2003 | Vrbanac et al. | 162/56 |
| 2004/0163779 | A1 * | 8/2004 | Pan | 162/5 |
| 2004/0256065 | A1 * | 12/2004 | Ahmed et al. | 162/26 |
| 2005/0022951 | A1 * | 2/2005 | Eltheimer et al. | 162/65 |
| 2006/0207734 | A1 * | 9/2006 | Day et al. | 162/70 |
| 2009/0090478 | A1 * | 4/2009 | Hollomon et al. | 162/65 |
| 2011/0061825 | A1 * | 3/2011 | Li et al. | 162/13 |
| 2011/0114273 | A1 * | 5/2011 | Yaqoob et al. | 162/23 |
| 2011/0297343 | A1 * | 12/2011 | Li et al. | 162/148 |

FOREIGN PATENT DOCUMENTS

| | | | | |
|---|---|---|---|---|
| CN | 1036304 | A1 | | 8/1978 |
| CN | 87103977 | A | | 4/1988 |
| CN | 1074259 | A | | 7/1993 |
| CN | 101082187 | A | | 12/2007 |
| CN | 101089291 | A | | 12/2007 |
| CN | 101089292 | A | | 12/2007 |
| DE | 2333742 | A | * | 1/1974 |
| EP | 2224059 | A1 | * | 9/2010 |
| JP | 49134901 | A | * | 12/1974 |
| WO | WO 8201019 | A1 | * | 4/1982 |
| WO | WO 2009015555 | A1 | * | 2/2009 |
| WO | WO 2009015556 | A1 | * | 2/2009 |
| WO | WO 2009056017 | A1 | * | 5/2009 |
| WO | WO 2010066195 | A1 | * | 6/2010 |

OTHER PUBLICATIONS

Hedjazi et al., "Alkaline sulfite-anthraquinone (AS/AQ) pulping of wheat straw and totally chlorine free (TCF) bleaching of pulps," 2009, Industrial Crops and Products 29, pp. 27-36.*

Abdul et al., "An optimization approach for the oxygen bleaching of kraft wheat straw cellulose," Jan. 1995, Tappi Journal, vol. 78, No. 1, pp. 83-89.*

International Search Report (PCT/ISA/210) for PCT/CN2008/001380 dated Nov. 6, 2008.

Written Opinion (PCT/ISA/237) for PCT/CN2008/001380 dated Nov. 6, 2008.

International Preliminary Report on Patentability (PCT/IPEA/409) for PCT/CN2008/001380 dated Feb. 22, 2010.

* cited by examiner

*Primary Examiner* — Jose A Fortuna

(74) *Attorney, Agent, or Firm* — Buchanan Ingersoll & Rooney PC

(57) ABSTRACT

Provided is an unbleached paper product made from grass type pulp, the unbleached paper product has a brightness of 35-60% ISO, the grass type pulp is unbleached. The unbleached paper product includes an unbleached toilet paper, an unbleached hand towel, an unbleached wiping paper, an unbleached duplicating paper, an unbleached meal container, an unbleached food wrapping paper and an unbleached printing paper. The paper products have a high intensity and have no detection of dioxin and absorbable organic halides in the harmful substance detection test.

12 Claims, No Drawings

METHOD FOR PREPARING A GRASS-TYPE UNBLEACHED PAPER PRODUCT

FIELD OF THE INVENTION

The present invention relates to an unbleached paper product and the preparation method thereof. More specifically, the invention relates to the application of unbleached cereal straw pulp to preparation of an unbleached paper product as a main raw material and the unbleached paper product prepared by the same.

BACKGROUND OF THE INVENTION

Household paper is a common consumable product, but due to psychological demand for whiteness and requirement for some physical indexes, paper is usually mainly prepared from bleached wood pulp, and the prior art gives some technical schemes for preparing the household paper, for example:

CN94105089 relates to complete wheat straw high-efficiency pharmaceutical and healthcare toilet paper, and a process for the complete wheat straw high-efficiency pharmaceutical and healthcare toilet paper of the invention comprises paper manufacturing.

CN200410026132 discloses a method for preparing household paper by compounding collagen fiber and plant fiber, and specifically the method comprises mixing bleached softwood (hardwood) pulp with wheat straw pulp to attain 1-4% mass concentration of the pulp, mixing the bleached softwood (hardwood) pulp and the wheat straw pulp with collagen fiber pulp, and adding a softening agent to a machine chest; then feeding resulting pulp to a paper machine wire after mixing; and pressing, drying, reeling and processing wet paper to obtain a finished product.

Pollution from paper and pulp making industry mainly lies in two steps of treating and discharging black liquor after cooking and bleaching pulp, in which pollution from the pulp bleaching step is particularly obvious. With respect to discharge of conventional chloric bleaching wastewater, wastewater contains common aquatic environment pollution factors such as COD and BOD and other special pollutants. For example, in the case of chlorine bleaching and hypochlorite bleaching, wastewater discharged from bleaching every 1 t of bagasse pulp contains 150-250 g of chloroform produced in hypochlorite bleaching, and wastewater discharged from bleaching every 1 t of wood pulp contains 700 g of chloroform. In addition to chloroform produced in the chlorine bleaching, the wastewater also contains more than 40 organic chlorides in which chlorophenols are the most, such as dichlorophenol and trichlorophenol, and contains dioxins and chlorinated furans, a majority of which are highly toxic. AOX has teratogenetic, cancerogenic and mutagenic hazards.

Developed countries and regions such as Western Europe, Hong Kong, Taiwan, Japan and Korea provide addition of harmful substances to office paper production processes, providing that neither chloric bleacher nor fluorescer can be used, and give mandatory requirement for content of harmful substances in the production process, and Japan controls whiteness (<70%) to avoid excessive use of fluorescers. The standards are that contents of COD and AOX in the wastewater are not more than 20 Kg/t paper and not more than 0.3 Kg/t paper respectively. In order to solve water pollution problem, all enterprises and the society pay a high price.

Toilet paper or household paper is prepared from wheat straw or plant fiber as the raw material in the above reference documents, as pulping method in the prior art is relatively lagged, grass material is always cooked to low hardness during preparing pulp from grass plant as the raw material, for example, the grass materials are cooked to hardness with 11-14 potassium permanganate number. In order to achieve such low hardness, amount of cooking liquor and time of heating and insulation are necessarily much, while high-temperature cooking and insulation in high-concentration chemical liquor certainly causes degradation and damage of cellulose and hemicellulose in the grass material, and inherent length of fiber can not be kept well, thus prepared straw pulp has low strength, and then resulting toilet paper and household paper have low quality. In addition, the bleaching step is necessary in the preparation method of the toilet paper and the household paper in the prior art, produces great pollution to environment and products, and produces dioxins, adsorbable organic halide and other carcinogenic substances, which produces great damages to users; moreover, even though wood pulp is used for preparing a variety of paper in the preparation method of the prior art, the fluorescers and other substances harmful for human health are also added and remained in products more or less, which can cause damages to health of users.

Therefore, the prior art does not describe how to prepare higher-performance pulp suitable for preparing various high-quality paper products with respect to the grass material, for disadvantages of the prior art, in more detail, and for the reason, the invention is proposed.

SUMMARY OF THE INVENTION

A primary objective of the invention is to provide a grass type unbleached paper product which comprises unbleached toilet paper, unbleached towel paper, unbleached wiping paper, unbleached duplicating paper, unbleached lunch box, unbleached food wrap paper and unbleached printing paper. The paper product has high strength, and neither dioxins nor adsorbable organic halide is detected in the harmful substance detection test.

In order to achieve the objective mentioned above, the invention uses the following technical scheme:

An unbleached paper product prepared from cereal straw pulp as a raw material has a whiteness of 25-60% ISO, preferably 35-45% ISO, and the cereal straw pulp is unbleached.

The unbleached straw pulp of the invention has a breaking length of 5.0-7.5 km, tear strength of 230-280 mN, folding number of 40-90, whiteness of 25-45% ISO and beating degree of 32-38° SR and preferably has a breaking length of 6.5-7.5 km, tear strength of 250-280 mN, folding number of 65-90, beating degree of 32-36° SR and whiteness of 35-45% ISO.

The unbleached paper product of the invention comprises unbleached toilet paper, unbleached towel paper, unbleached wiping paper, unbleached duplicating paper, unbleached lunch box, unbleached food wrap paper and unbleached printing paper.

The unbleached paper product of the invention is unbleached toilet paper, pulp used for the unbleached toilet paper comprises 70-100% of unbleached straw pulp and 0-30% of unbleached wood pulp, and transverse suction range of a finished layer thereof is 30-100 mm/100 s, preferably 40-100 mm/100 s and more preferably 50-80 mm/100 s.

The unbleached toilet paper of the invention has a tensile index of 4-12 N.m/g, preferably 8-12 N.m/g; the unbleached toilet paper has a softness of 120-180 mN, preferably 120-150 mN; the unbleached toilet paper has an basis weight of 10.0-18.0 g/m$^2$, preferably 11.0-13.0 g/m$^2$.

The unbleached paper product of the invention is unbleached towel paper, pulp used for the unbleached towel paper comprises 70-100% of unbleached straw pulp and 0-30% of unbleached wood pulp, and longitudinal wet tensile strength of the unbleached towel paper is 22-55 N/m, preferably 30-45 N/m.

The transverse suction range of a finished layer of the unbleached towel paper of the invention is 30-100 min/100 s, preferably 40-100 mm/100 s, more preferably 50-80 mm/100 s.

The unbleached towel paper of the invention has a softness of 120-180 mN, preferably 120-150 mN, and the unbleached towel paper has an basis weight of 23.0-45.0 g/m$^2$, preferably 30.0-40.0 g/m$^2$.

The unbleached paper product of the invention is unbleached lunch box which is prepared from 70-100% unbleached straw pulp and 0-30% unbleached wood pulp and has performance parameter meeting requirements for Grade A product in GB 18006.1-1999.

The unbleached paper product of the invention is unbleached duplicating paper, pulp used for the unbleached duplicating paper comprises 50-80% of unbleached straw pulp and 20-50% of unbleached wood pulp, mean longitudinal and transverse breaking length of the unbleached duplicating paper is 3.2-7.5 km, preferably 4.5-7.5 km and more preferably 6.0-7.5 km.

Transverse folding number of the unbleached duplicating paper of the invention is 60-200 and preferably 80-185.

Basis weight of the unbleached duplicating paper of the invention is 60.0-75.0 g/m$^2$, preferably 65.0-72.0 g/m$^2$ and more preferably 69.0-72.0 g/m$^2$, and opacity thereof is 82.0-98.0% and preferably 90-98%.

The unbleached paper product of the invention is unbleached food wrap paper, pulp used for the unbleached food wrap paper comprises 50-70% of unbleached straw pulp and 30-50% of unbleached wood pulp, and breaking length of the unbleached food wrap paper is 3.2-7.61 cm and preferably 4.5-7.61 cm.

Basis weight of the unbleached food wrap paper of the invention is 45-65 g/m$^2$ and preferably 50-60 g/m$^2$, and transverse folding number of the same is 90-200 and preferably 120-200.

Transverse tear strength of the unbleached food wrap paper of the invention is 300-600 mN and preferably 400-600 mN.

The unbleached offset printing paper of the invention has a whiteness of 30-60% ISO and is prepared from 65-85% of unbleached straw pulp and 15-35% of unbleached wood pulp.

Breaking length of the unbleached offset printing paper of the invention is 2.5-5.5 km and preferably 3.5-5.5 km.

Opacity of the unbleached offset printing paper of the invention is 82-98%, preferably 85-98% and more preferably 92-98%.

Folding number of the unbleached offset printing paper of the invention is 10-35 and preferably 15-35.

The unbleached paper product of the invention is unbleached wiping paper, pulp used for the unbleached wiping paper comprises 70-100% of unbleached straw pulp and 0-30% of unbleached wood pulp, and longitudinal wet tensile strength of the unbleached wiping paper is 22-55 N/m and preferably 30-45 N/m.

Transverse suction range of the unbleached wiping paper is 30-100 mm/100 s, preferably 40-100 mm/100 s, and more preferably 50-80 min/100 s.

The unbleached wiping paper has a softness of 120-200 mN, preferably 120-180 mN; and the unbleached wiping paper has an basis weight of 14.0-36.0 g/m$^2$, preferably 18-28 g/m$^2$.

Preparation of the unbleached straw pulp of the invention comprises cooking and washing steps, and the cooking step comprises obtaining high-hardness pulp with a potassium permanganate number of 16-28 and beating degree of 10-24° SR after cooking grass plants as the raw material; preferably the unbleached straw pulp is high-hardness pulp with a potassium permanganate number of 16-23 and beating degree of 10-24° SR after cooking grass plants as the raw material.

Preparation of the unbleached straw pulp of the invention comprises cooking and oxygen delignification steps, and the oxygen delignification comprises: pumping high-hardness pulp with the potassium permanganate number of 16-28 which is obtained after cooking to an oxygen delignification reaction tower and adding sodium hydroxide and oxygen; and allowing delignification reaction of the high-hardness pulp in the oxygen delignification reaction tower to obtain pulp with hardness being potassium permanganate number of 10-14.

Preferably, the oxygen delignification is single stage and executed in the oxygen delignification reaction tower; the high-hardness pulp is at 95-100° C. and 0.9-1.2 MPa at an inlet of the reaction tower and at 100-105° C. and 0.2-0.6 MPa at an outlet; alkali used in the oxygen delignification treatment is 2-4% of bone dry pulp based on sodium hydroxide, and oxygen added is 20-40 kg for every ton of bone dry pulp; and the high-hardness pulp reacts in the reaction tower for 60-90 min.

The straw pulp of the invention is prepared from grass plants as the raw material by cooking, washing, oxygen delignification steps, etc., and the grass material comprises one or a combination of a plurality of rice straw, wheat straw, cotton stalk, bagasse, reed or giant reed.

The unbleached paper product of the invention is prepared by beating the straw pulp as the main raw material in combination with a certain amount of unbleached wood pulp or other papermaking pulp if necessary, and then manufacturing paper with the pulp. As the straw pulp is high-quality unbleached straw pulp and has excellent performances such as high strength and high folding number, and the paper product is unbleached, strength of fiber is increased by 30%-50%, yield of fiber is increased by 10%, and strength of the paper product such as breaking length is greatly improved. The unbleached paper product can also greatly reduce pollution to environment, avoid generation of harmful substances and avoid damages to human health.

The paper product has no dioxins and adsorbable organic halide detected in a harmful substance detection test.

Another objective of the invention is to provide a preparation method of an unbleached paper product.

In order to achieve the objective mentioned above, the invention uses the following technical scheme:

A method for preparing the unbleached paper product, the method comprising:

(1 ) cooking the grass material, pressing, washing, disintegration and then performing oxygen delignification treatment to obtain the unbleached straw pulp;

(2 ) beating the unbleached straw pulp and the unbleached wood pulp respectively to obtain beaten pulp;

(3 ) mixing the unbleached straw pulp and the unbleached wood pulp or other papermaking pulp in step (2 ) based on parts by weight as required by the paper product, and blending the pulp even; and (4 ) manufacturing with the beaten pulp to obtain the unbleached paper product.

In the preparation method of the unbleached paper product of the invention, the step (3 ) also comprises adding other adjuvants required by paper product preparation except fluorescers during or before the mixing process. The preparation method is a conventional preparation method of various paper products in the prior art.

In the step (1 ) of the invention, the grass material is cooked to obtain high-hardness pulp with hardness of 16-28 and degree of beating of 10-24° SR.

The cooking of the invention comprises one of ammonium sulfite, anthraquinone-sodium hydroxide, sulfate or basic sodium sulfite cooking methods:

in the ammonium sulfite cooking method, ammonium sulfite used is 9-13% of the bone dry raw material;

in the anthraquinone-sodium hydroxide cooking method, alkali used is 9-15% of the bone dry raw material based on sodium hydroxide;

in the sulfate cooking method, alkali used is 8-11% of the bone dry raw material based on sodium hydroxide; and in the basic sodium sulfite cooking method, sodium hydroxide used is 11-15% of the bone dry raw material and sodium sulfite used is 2-6% of the bone dry raw material.

The cooking of the invention comprises one of ammonium sulfite, anthraquinone-sodium hydroxide, sulfate or basic sodium sulfite cooking methods:

1 ) If the Grass Material is Cooked in a Spherical Batch Cooker or a Continuous Cooker: the ammonium sulfite cooking method comprises:

(1 ) adding cooking liquor to the grass material, in which ammonium sulfite used is 9-13% of the bone dry raw material, and liquor ratio is 1:2-4; and (2 ) feeding steam and heating to 165-173° C., in which time for the whole process of heating, relieving and insulating is 160-210 min;

the anthraquinone-sodium hydroxide cooking method comprises:

(1 ) adding cooking liquor to the grass material, in which alkali used is 9-15% of the bone dry raw material based on sodium hydroxide, liquor ratio is 1:2-4, and anthraquinone added is 0.5-0.8% of the bone dry raw material; and (2 ) feeding steam and heating to 160-165° C., in which time for the whole process of heating, relieving and insulating is 140-190 min;

The sulfate cooking method comprises:

(1 ) adding cooking liquor to the grass material, in which alkali used is 8-11% of the bone dry raw material based on sodium hydroxide, liquor ratio is 1:2-4, and sulfidity is 5-8%; and (2 ) feeding steam and heating to 165-173° C., in which time for the whole process of heating, relieving and insulating is 150-200 min;

The basic sodium sulfite cooking method comprises:

(1 ) adding cooking liquor to the grass material, in which sodium hydroxide used is 11-15% of the bone dry raw material by weight, sodium sulfite used is 2-6% of the bone dry raw material by weight, anthraquinone used is 0.02-0.08% of the bone dry raw material by weight and cooking liquor ratio is 1:3-4; and (2 ) feeding steam and heating to 160-165° C., in which time for the whole process of heating, relieving and insulating is 140-190 min 2 ) If the Grass Material is Cooked in a Vertical Cooker:

The ammonium sulfite cooking method comprises:

(1 ) adding cooking liquor to the grass material, in which ammonium sulfite used is 9-15% of the bone dry raw material, and liquor ratio is 1:6-10; and (2 ) filling the grass material in hot black liquor in the cooker by a filler, closing a cooker cover after the cooker is full, supplementing the cooking liquor at 130-145° C. while discharging air from the cooker and boosting to 0.6-0.75 MPa, and heating the cooking liquor to 156-173° C., in which time for heating, insulating and exchanging is 220 min; and finally pumping pulp to a blow tank;

the anthraquinone-sodium hydroxide cooking method comprises:

(1 ) adding cooking liquor to the grass material, in which alkali used is 9-17% of the bone dry raw material based on sodium hydroxide, liquor ratio is 1:6-9, and anthraquinone added is 0.5-0.8% of the bone dry raw material; and;

(2 ) filling the grass material in hot black liquor in the cooker by a charger, closing a cooker cover after the cooker is full, supplementing the cooking liquor at 130-145° C. while discharging air from the cooker and boosting to 0.4-0.6 MPa, and heating the cooking liquor to 147-165° C., in which time for heating, insulating and exchanging is 170-200 min; and finally pumping pulp to a blow tank;

the sulfate cooking method comprises:

(1 ) adding cooking liquor to the grass material, in which alkali used is 8-13% of the bone dry raw material based on sodium hydroxide, liquor ratio is 1:6-10, and sulfidity is 5-9%; and (2 ) filling the grass material plant in hot black liquor in the cooker by a charger, closing a cooker cover after the cooker is full, supplementing the cooking liquor at 130-145° C. while discharging air from the cooker and boosting to 0.5-0.65 MPa, and heating the cooking liquor to 155-168° C., in which time for heating, insulating and exchanging is 180-220 min; and finally pumping pulp to a blow tank;

the basic sodium sulfite cooking method comprises:

(1 ) adding cooking liquor to the grass material, in which sodium hydroxide is 9-17% of the bone dry raw material by weight, sodium sulfite used is 4-8%, anthraquinone is 0.04-0.08% and cooking liquor ratio is 1:6-10; and (2 ) filling the grass material in hot black liquor in the cooker by a charger, closing a cooker cover after the cooker is full, supplementing the cooking liquor at 145° C. while discharging air from the cooker and boosting to 0.45-0.6 MPa, and heating the cooking liquor to 152-165° C., in which time for heating, insulating and exchanging is 180-220 min; and finally pumping pulp to a blow tank.

The oxygen delignification of the invention comprises:

(1 ) pumping the high-hardness pulp with hardness of 16-28 potassium permanganate number which is obtained after cooking to an oxygen delignification reaction tower, and adding sodium hydroxide and oxygen; and (2 ) allowing oxygen delignification reaction of the high-hardness pulp in the oxygen delignification reaction tower to obtain pulp with hardness of 10-14 potassium permanganate number;

Preferably, the oxygen delignification is single stage and executed in one oxygen delignification reaction tower; the high-hardness pulp is at 90-100° C. and 0.9-1.2 MPa at an inlet of the reaction tower and at 95-105° C. and 0.2-0.4 MPa at an outlet; alkali used in the oxygen delignification treatment is 2-4% of bone dry pulp based on sodium hydroxide, and oxygen added is 20-40 kg for every ton of bone dry pulp; and the high-hardness pulp reacts in the reaction tower for 60-90 min.

A use of unbleached straw pulp in preparation of the unbleached paper product according to any one of claims 1-3.

The unbleached straw pulp has a breaking length of 5.0-7.5 km, tear strength of 230-280 mN, whiteness of 25-45% ISO, folding number of 40-90 and beating degree of 32-38° SR, and preferably has a breaking length of 6.5-7.5 km, tear strength of 250-280 mN, folding number of 65-90, beating degree of 32-36° SR and whiteness of 35-45% ISO.

A preparation method of the unbleached straw pulp comprises cooking, washing and oxygen delignification steps, and the cooking comprises obtaining high-hardness pulp with potassium permanganate number of 16-28 and beating degree of 10-24° SR after cooking grass plants as the raw material; preferably, the unbleached straw pulp is the high-hardness pulp with potassium permanganate number of 16-23 and beating degree of 10-24° SR after cooking grass plants as the raw material.

Preparation of the unbleached straw pulp comprises cooking, washing and oxygen delignification steps, and the oxygen delignification step comprises: pumping high-hardness pulp with the potassium permanganate number of 16-28 which is obtained after cooking to an oxygen delignification reaction tower and adding sodium hydroxide and oxygen; and allowing delignification reaction of the high-hardness pulp in the oxygen delignification reaction tower to obtain pulp with hardness being potassium permanganate number of 10-14.

Preferably, the oxygen delignification is single stage and executed in the oxygen delignification reaction tower; the high-hardness pulp is at 95-100° C. and 0.9-1.2 MPa at an inlet of the reaction tower and at 100-105° C. and 0.2-0.6 MPa at an outlet; alkali used in the oxygen delignification treatment is 2-4% of bone dry pulp based on sodium hydroxide, and oxygen added is 20-40 kg for every ton of bone dry pulp; and the high-hardness pulp reacts in the reaction tower for 60-90 min.

The cooking comprises one of ammonium sulfite, anthraquinone-sodium hydroxide, sulfate or basic sodium sulfite methods:

in the ammonium sulfite cooking method, ammonium sulfite used is 9-13% of the bone dry raw material;

in the anthraquinone-sodium hydroxide cooking method, alkali used is 9-15% of the bone dry raw material based on sodium hydroxide; and in the sulfate cooking method, alkali used is 8-11% of the bone dry raw material based on sodium hydroxide; and in the basic sodium sulfite cooking method, sodium hydroxide used is 11-15% of the bone dry raw material and sodium sulfite used is 2-6% of the bone dry raw material.

The washing step comprises:

(1 ) feeding the high-hardness pulp with concentration of 8-15% from an inlet of a press master, and pressing black liquor under the action of pressing force to obtain pressed pulp with concentration of 18-25%; in which the press master is preferably a single screw press master, a double screw press master or a double roll press master; and (2 ) washing the pressed pulp with one or both of black liquor with concentration of 3-6.2° Be', pH at 8-8.3 at 70-80° C. and clean water at 70-80° C. in a vacuum pulp washer, a pressure pulp washer or a horizontal belt pulp washer.

In order to describe summary and technical schemes of the invention clearly, terms used in the invention are defined as follows, and in the case of inconsistency between definitions of any other literatures and the invention, definitions in the invention prevail as follows:

The unbleached straw pulp of the invention refers to straw pulp obtained from one or more combined raw materials of annual plants comprising, but not limited to, wheat straw, rice straw, cotton stalk, bagasse, giant reed and reed without any bleaching completely or straw pulp prepared from grass plants through oxygen delignification without other bleaching.

The unbleached paper product of the invention refers to the paper product mainly prepared by a conventional method from straw pulp which is prepared from grass plants as the raw material without any bleaching completely or the paper product mainly prepared by a conventional method from straw pulp which is prepared from grass plants as the raw material through oxygen delignification without other bleaching.

In the preparation method of the unbleached straw pulp of the invention, the prior art can be used for preparing for the grass material at first, that is, a conventional dry/wet method is used for preparing for the material to remove leaf, spike, grain, pith, kernel and other impurities, thus relieving load of the subsequent process and increasing mass of wheat straw pulp. The dry and wet material preparation can be performed by existing conventional equipment such as straw cutter, screening machine, dusting machined, wet washing and rubbing machine and oblique spiral dewaterer. The prepared and dewatered grass material can also be fine material and is bone dry grass without water in grass material, and the length of chopped straw is usually 15-30 mm, and the material preparation process is well known among those skilled in the art.

In the material preparation course of the invention, a hammer crusher can be used for dry material preparation, and the preparation course comprises:

(1 ) cutting and rubbing the grass material with the hammer crusher to obtain the cut and rubbed material;

The grass material is fed to the hammer crusher in the step, and the hammer crusher comprises a conveying and feeding segment, a crushing and rubbing segment and a scattering and discharging segment. The grass material is subject to extrusion effect, thus the grass material with round cross section is flattened to separate leaf, arista, kernel, grain, pith and other impurities from straw and then the grass material is discharged from an outlet of the hammer crusher. The discharged grass material is 20-50 mm long.

The hammer crusher of the invention is a hammer mill for existing material preparation. Speed of the hammer crusher is 500-800 rpm, the grass materials is fed to the hammer crusher at the speed of 0.5-1.3 m/s, and too low or too high feeding speed can cause a quantity of grass material not to be rubbed completely, thus affecting subsequent infiltration of the cooking liquor and further affecting quality of the straw pulp.

The grass material has a waxy layer on an outer layer and a pith layer inside stalk thereof; in a general material preparation method, when the outer layer is macerated in the cooking liquor, wax is removed rapidly, but the cooking liquor is difficult to infiltrate into the inner layer due to air existing in the inner layer of the stalk. The grass material is cut and rubbed by the hammer crusher, which benefits adequate maceration of the grass material, and high-quality straw pulp is easily obtained after the cooking.

(2 ) dedusting the cut and crushed material;

the cut and crushed material is dedusted for the reason that cut chopped straw contains dust, sandstone, grass blade, grass spike and other impurities, and most impurities are removed by dedusting treatment, thus chemical consumption for cooking can be reduced and cooking time can also be correspondingly reduced in the cooking process after the material preparation.

The dusting machine used in the dedusting treatment of the invention can be the dusting machine used for preparing for the grass material in the prior art, including roll dusting machine, double cone dusting machine and cyclone dusting machine, and the dusting machine is preferably the cyclone dusting machine. Air rate is 30000-38000 $m^3/h$ and air pressure is 210 mm water cylinder during dedusting by the cyclone dusting machine. Dust contained in the grass material can be largely removed under such condition, thus relieving load of subsequent cooking.

(3 ) Screening the dedusted material.

The dedusted grass material tends to carry impurities such as large chopped straw and powder, part of which are difficult to be infiltrated by the cooking liquor during cooking so as to produce undigested substances; although part of powder reacts with the cooking liquor, viscosity of the black liquor is increased, which affects cycle of the cooking liquor, causes uneven cooking and difficulty in operation and affects amount of the black liquor extracted from the paper pulp and washing quality of the pulp, thus the screening step is very important in the dry material preparation of the grass material.

The cylindrical sieve of the invention is that used for the dry material preparation of the grass materials in the prior art. The cylindrical sieve has a speed of 18-29 rpm and an inclination angle of 6-12° and is a double layer cylindrical sieve, side length of rectangular sieve pores of an internal sieve plate of the cylindrical sieve is 30-40 mm, and diameter of sieve pores of an external sieve plate is 4-6 mm; large chopped straw and other small impurities such as mud, sand and dust are screened in the screening process, thus ensuring clean paper pulp.

Removal rate of impurities of the grass material exceeds 90% after the dry material preparation method of the invention, but removal rate of impurities is 70% for a general dry material preparation method, which can reduce dust in the pulp, prepare clean pulp, achieve high yield 3-6% higher than that of the general method and lower production cost by 2-5% by the method of the invention.

The raw material can be macerated by the method of the invention before the cooking, the wheat straw material is macerated with maceration extract to attain liquor ratio of 1:2-4, insulated and mixed in a spiral macerator at 85° C. and normal pressure for more than 10 min, in which time for insulating and mixing at 85-95° C. is preferably 10-40 min. Therefore, the maceration extract is in full contact with the wheat straw material and the wheat straw material is macerated evenly and fully.

The maceration extract can be alkali solution with certain concentration, for example alkali solution containing alkali being 4% of the bone dry raw material by weight based on sodium hydroxide, and can also be mixture of the alkali solution and the black liquor which has a concentration of 11-14° Be' (20° C.). The raw material is macerated to recycle heat and remaining alkali in the black liquor and reduce energy and resource consumption; maceration pretreatment of the raw material causes the black liquor which is extracted during heating and mainly contains parenchyma cells, hemicellulose and lignin to be separated and discharged for getting ready for the next cooking step. Maceration of the raw material belongs to a pretreatment process with the main purpose of facilitating the delignification reaction in a subsequent cooking process.

Grass pulping refers to properly removing lignin from the grass material by the action of the cooking liquor and retaining cellulose and hemicellulose as much as possible for facilitating papermaking. Actually, the lignin, cellulose, hemicellulose and other components in the raw material are subject to certain chemical changes, degradation and damage at different degrees under the action of high temperature in the cooking process, thus a change rule of the raw material in the cooking process must be studied to establish suitable cooking condition. In the pulping method of the invention, cooking is performed under a condition with cellulose and hemicellulose damage reduced as much as possible through systematic study on consumption and concentration of the cooking liquor, cooking and insulating time and cooking temperature, thus achieving the purposes of reducing production cost, saving energy source and improving pulping yield.

In the method of the invention, high-hardness pulp is obtained after cooking and has hardness being 16-28 potassium permanganate number equivalent to 24-50 Kappa number and beating degree of 10-24° SR; preferably, the high-hardness pulp has hardness being 18-27 potassium permanganate number equivalent to 29-48 Kappa number; most preferably, the high-hardness pulp has hardness being 20-25 potassium permanganate number equivalent to 34-42 Kappa number.

The high-hardness pulp prepared by the cooking in the invention is used as the raw material for preparing unbleached pulp. The preparation method by cooking in the prior art has problems of long cooking and insulating time, high cooking temperature and a large amount of cooking liquor used and long insulating time. But in the preparation method of the invention, the cooking liquor used is less and the cooking and insulating time is greatly shortened. In the cooking method of the invention, the cooking is performed under a condition with cellulose and hemicellulose damage reduced as much as possible through systematic study on consumption and concentration of the cooking liquor, cooking and insulating time and cooking temperature, thus achieving purposes of reducing production cost, saving energy source and improving pulping yield. Yield of the high-hardness pulp obtained by the cooking method is 58-68%.

In the preparation method of the invention, the obtained high-hardness pulp is kept at certain pressure which is 0.75 MPa and then blown to a blow tank after ending cooking. Diluent can be the black liquor used for the maceration above. At the moment, the high-hardness pulp in the blow tank has concentration of 8-15% and hardness being 16-28 potassium permanganate number equivalent to 26-50 Kappa number; the blow tank and the spiral press master are connected via a conveying pump, the conveying pump conveys the high-hardness pulp from the blow tank to the inlet of the spiral press master, the high-hardness pulp is fed from the inlet of the spiral press master and discharged from the outlet of the press master after being pressed, and concentration of the pulp discharged increases from 8-15% to 20-28%, and the pulp becomes high-concentration and high-hardness pulp at 70-80° C. Most black liquor is pressed out and stored in a black liquor tank while pressing the pulp. The press master used is the spiral press master for extracting the black liquor in the prior art, preferably a single spiral press master or a double spiral press master and a double roll press master with variable diameter and pitch.

As great pressing force is generated and temperature rises rapidly in the pulp pressing process while pressing pulp by the press master, fiber is forced to be separated, devillicated, fibrillated and bruised, a primary wall is damaged, the fiber absorbs enough energy and generates great stress inside and reaction performance of the high-hardness pulp is greatly improved. Meanwhile, the fiber is subject to fibrillation, epidermal organic substances and impurities in the fiber are dissolved in the black liquor and discharged from a liquor discharge tank, and fiber purity is greatly improved. Ash and impurities in the black liquor are also discharged along with the black liquor for getting fully ready for the next step. Most preferably, the press master of the invention is the spiral press master with variable diameter, and compressed pulp layers of the pulp within a slowly reducing space are unitedly dewatered internally and externally by the press master with variable diameter. After the selected single spiral press master with variable diameter of the invention presses the high-hardness pulp, beating degree of the high-hardness pulp does not change largely.

The double roll press master can also be used while pressing pulp, and double roll press master can be used in the same manner as the single spiral press master to minimize damages to the fiber, and as the double roll press master has a high black liquor extraction rate, water consumption in the subsequent washing process is greatly reduced and much less than that of the single spiral press master, and concentration of the high-hardness pulp exceeds 20% and reaches 25% at most after pressing.

In the preparation method of the invention, the high-hardness pulp obtained after the cooking or the high-concentration and high-hardness pulp obtained after the pressing is first diluted to 2.5-3.5% with the black liquor with concentration of 11-14° Be' (20° C.) and then screened by a screening method in the prior art, for example hop screening method with a loss of 0.2-0.5% before washing the high-hardness pulp. Then, washing is performed by the vacuum pulp washer or the pressure pulp washer in the prior art. An objective of washing by the vacuum pulp washer is to easily form pressure difference between inside and outside of fibrocyte being cleaned, which is further beneficial to reach high clean degree in the washing process. In order to reach higher clean degree, washing can be performed once, twice or three times.

In the preparation method of the invention, pulp concentration is 9-11% after the washing, the pulp can be conveyed to a disintegrator by a spiral conveyer for disintegration, and the disintegrated pulp has beating degree of 26-28° SR and wet weight of 1.5-1.7 g at 65-70 ° C. The disintegrator is existing disintegration equipment such as deflaker, disc refiner or defibering machine. The disintegration can separate the fiber by rubbing and expose lignin between fiber and fiber, which benefits the following oxygen delignification step.

The high-hardness pulp obtained by the cooking or the pulp obtained after the disintegration or the pulp obtained after the washing is subject to oxygen delignification which refers to bleaching under the condition that alkali used is 2-4% of the bone dry pulp based on sodium hydroxide and oxygen added is 20-40 kg for every ton of pulp for 60-90 min. At the moment, hardness k value (potassium permanganate number) of the pulp falls to 11-13 equivalent to 12.5-17 Kappa number and beating degree is 32-36° SR. The oxygen delignification of the invention is preferably single stage and performed in an oxygen delignification reaction tower, and the high-hardness pulp is at 90-100° C. and 0.9-1.2 MPa at the inlet of the reaction tower and at 95-105° C. and 0.2-0.4 MPa at the outlet of the reaction tower. The main purpose of the single-stage oxygen delignification is to further ensure strength of the paper pulp, and the single-stage oxygen delignification has less degradation effect on cellulose relative to multistage oxygen delignification. In general, process parameters of the preferred single-stage oxygen delignification in the invention comprises low temperature and relatively long time with the purpose of more moderately performing the delignification reaction and avoiding the degradation of the cellulose as much as possible. Concentration of the high-hardness pulp is preferably 8-18% before the oxygen delignification treatment. The oxygen delignification is performed at medium concentration. The medium-concentration oxygen delignification has the main advantages of less investment, much more easy treatment of the pulp than high-concentration pulp due to successful medium and high concentration pulp mixing and pumping techniques, less equipment corrosion resulting from lower pulp concentration and no risk of burning in oxygen.

The unbleached pulp obtained from the steps has a breaking length of 5.0-7.5 km, tear strength of 230-280 mN, whiteness of 25-45% ISO, folding number of 40-90 and beating degree of 32-38° SR.

The invention has the following benefits:

(1 ) The unbleached pulp can avoid damage of chemicals used in the bleaching process to human, and the prepared unbleached paper product can not contain dioxins, adsorbable organic halide and other carcinogenic substances, thus producing no damage to human.

(2 ) The unbleached straw pulp can reduce effects of the bleaching process on breaking length, tear strength and folding number, and different preparation methods generate very excellent performances of the prepared pulp, which can greatly improve quality of the unbleached paper product.

(3 ) The unbleached paper product is prepared from the straw pulp as the raw material without any fluorescer, thus the prepared paper product can not be subject to secondary pollution of the substances, original properties of the paper product can be kept and no damage is produced to human.

(4 ) As the preparation method of the unbleached straw pulp is improved, strength and other properties of the prepared straw pulp are greatly improved, the straw pulp can be mixed with a small amount of wood pulp or other paper-making pulp for preparing paper products and even can be directly manufactured into high-quality paper products.

DETAILED DESCRIPTION OF PREFERRED EMBODIMENTS

EXAMPLE 1

Wheat straw material is prepared by a hammer crusher and then put into a spherical digester, cooking liquor is added to the spherical digester, ammonium sulfite added is 9% of the bone dry raw material, liquor ratio is 1:3, and the mixture is heated to 110° C. for the first time, insulated at the temperature for 30 min, then relieved for 25 min, heated to 168° C. for 60 min for the second time and insulated for 90 min. The high-hardness pulp obtained after cooking has hardness of 22 equivalent to 35.5 Kappa number and beating degree of 11.6° SR and is diluted to 2.5% with diluted black liquor and then screened by a screening method in the prior art, for example hop screening method, with loss of 0.5%. The high-hardness pulp is washed by a vacuum pulp washer in the prior art. The high-hardness pulp with concentration of 10% obtained after washing is conveyed to a medium-concentration pulp pipe. The high-hardness pulp is conveyed to an oxygen delignification reaction tower via a medium-concentration pulp pump. The pulp is mixed with added oxygen of 20 kg for 1 t pulp and alkali solution with alkali content being 4% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 1% of the bone dry raw material, the inlet temperature is 95° C., the inlet pressure is 0.9 Mpa, the condition is kept 75 min to allow the pulp to receive sufficient delignification reaction, temperature is 100° C. and pressure is kept at 0.3 MPa at the top of the tower. The pulp is blown to a pulp chest and diluted to obtain the unbleached pulp after finishing treatment. The unbleached straw pulp has a breaking length of 5.0 km, folding number of 40, tear strength of 220 mN, whiteness of 40% ISO and beating degree of 34° SR. The unbleached straw pulp is beaten to a degree of 33° SR with wet weight of 2.1 g, and additionally prepared unbleached wood pulp is beaten to a degree of 20° SR with wet weight of 12 g.

Up to 65% of the beaten unbleached straw pulp and 35% of beaten unbleached wood pulp by weight are mixed evenly and manufactured to obtain the unbleached offset printing paper. The unbleached offset printing paper has an basis weight of 69.0 g/m$^2$, opacity of 85%, breaking length of 3.9 km, whiteness of 49% ISO, transverse folding number of 19, and tear strength of 258 mN.

EXAMPLE 2

Rice straw material is prepared by a hammer crusher and then put into a spherical batch cooker, cooking liquor is added to the spherical batch cooker, ammonium sulfite added is 13% of the bone dry raw material, liquor ratio is 1:4, and the mixture is heated to 120° C. for the first time, insulated at the temperature for 40 min, then relieved for 25 min, heated to 168° C. for 60 min for the second time and insulated for 90 min. The high-hardness pulp obtained after cooking has hardness of 16 equivalent to 23 Kappa number and beating degree of 23.4° SR and is diluted to 2.5% with diluted black liquor and then screened by a screening method in the prior art, for example, hop screening method, with loss of 0.2%. The high-hardness pulp is washed by a vacuum pulp washer in the prior art. The high-hardness pulp with concentration of 10% obtained after washing is heated to 70° C. and conveyed to a medium-concentration pulp pipe by a spiral conveyer. The pulp is subject to thermal refining in the medium-concentration pulp pipe to eliminate air and to be fluidized and then conveyed to an oxygen delignification reaction tower by a centrifugal medium-concentration pulp pump. The pulp is mixed with added oxygen of 20 kg for 1 t pulp and alkali solution with alkali content being 3.5% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 1% of the bone dry raw material, the inlet temperature is 95° C., the inlet pressure is 0.9 Mpa, the condition is kept 75 min to allow the pulp to receive sufficient delignification reaction, temperature is 100° C. and pressure is kept at 0.4 MPa at the top of the tower. The pulp is blown to a pulp chest and diluted to obtain the unbleached pulp after finishing treatment. The unbleached straw pulp has a breaking length of 6.8 km, folding number of 50, tear strength of 250 mN, whiteness of 41% ISO and beating degree of 36° SR.

Up to 70% of the unbleached straw pulp and 30% of unbleached wood pulp by weight are beaten at the beating concentration of 3.0% and 4.5% respectively in a double disc refiner, and quality standards for finished pulp obtained after beating are as follows: beating degree of 34° SR and wet weight of 1.8 g for the straw pulp and beating degree of 22° SR and wet weight of 10 g for the wood pulp. The unbleached wood pulp is that of the prior art and has a breaking length of 6.5 km, tear strength of 1000 mN, whiteness of 18% ISO and folding number of 1000.

The beaten pulp is mixed evenly and manufactured to obtain the unbleached offset printing paper. The manufacturing comprises manufacturing the finished pulp obtained after the beating and is performed in a multi-cylinder and long-wire paper machine.

The unbleached offset printing paper has an basis weight of 70.0 g/m$^2$, opacity of 84%, breaking length of 4.9 km, whiteness of 52% ISO, transverse folding number of 22, and tear strength of 229 mN.

EXAMPLE 3

Bagasse material is prepared conventionally by a dry method, has pith removed and then is put into a spherical digester, cooking liquor is added to the spherical digester, ammonium sulfite added is 11% of the bone dry raw material, liquor ratio is 1:2.5, and the mixture is heated to 130° C. for the first time, insulated at the temperature for 20 min, then relieved for 20 min, heated to 165° C. for 50 min for the second time and insulated for 70 min. High-hardness pulp obtained by cooking has hardness of 21 equivalent to 32 Kappa number and beating degree of 14.2° SR and is conveyed to a double spiral press master for extracting the black liquor in the prior art for pressing, the high-hardness pulp with concentration of 25% obtained after pressing is diluted to 2.5% with black liquor and then conveyed to the vacuum pulp washer for washing, and the obtained pulp is heated to 70° C. by a spiral conveyor and conveyed to a medium-concentration pulp pipe after concentration of the pulp reaches 10-13%. The pulp is subject to thermal refining in the medium-concentration pulp pipe to eliminate air and to be fluidized and then conveyed to an oxygen delignification reaction tower by a centrifugal medium-concentration pulp pump. The pulp is mixed with added oxygen of 30 kg for 1 t pulp and alkali solution with alkali content being 3% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 0.8% of the bone dry raw material, the inlet temperature is 98° C., the inlet pressure is 1.05 Mpa, the condition is kept 85 min to allow the pulp to receive sufficient delignification reaction, temperature is 102° C. and pressure is kept at 0.4 MPa at the top of the tower. The pulp is blown to a pulp chest and diluted to obtain the unbleached pulp after finishing treatment. The unbleached straw pulp has a breaking length of 6.0 km, folding number of 70, tear strength of 230 mN, whiteness of 40% ISO and beating degree of 35° SR.

Up to 85% of the unbleached straw pulp and 15% of unbleached wood pulp by weight are beaten at the beating concentration of 3.2% and 4.0% respectively in a double cylinder refiner, and quality standards for finished pulp obtained after beating are as follows: concentration of 3.2%, beating degree of 33° SR and wet weight of 2.0 g for straw pulp and concentration of 4.0%, beating degree of 18° SR and wet weight of 11 g for wood pulp. The beaten pulp is mixed evenly and manufactured to obtain the unbleached offset printing paper. The manufacturing is performed in multi-cylinder and short and long-wire paper machines.

The unbleached offset printing paper has an basis weight of 65.0 g/m$^2$, opacity of 85%, breaking length of 5.5 km, whiteness of 48% ISO, transverse folding number of 28, and tear strength of 230 mN.

EXAMPLE 4

Giant reed is prepared by a hammer crusher and then put into a spherical digester, cooking liquor is added to the spherical digester, ammonium sulfite added is 11% of the bone dry raw material, liquor ratio is 1:3, and the mixture is heated to 140° C. for the first time, insulated at the temperature for 40 min, then relieved for 20 min, heated to 175° C. for 60 min for the second time and insulated for 90 min. High-hardness pulp obtained after cooking has hardness of 19 equivalent to 28.5 Kappa number and beating degree of 15.6° SR and is conveyed to a single spiral press master with variable diameter for extracting the black liquor in the prior art for pressing, the high-hardness pulp with concentration of 26% is obtained after pressing, the pulp from the press master is diluted to 2.5-3.0% with diluted black liquor and then conveyed to a hop sieve for coarse pulp screening with hop sieve loss of 0.2%, the pulp is cleared off impurities by a high-concentration deslagging machine with loss of 0.1%, the pulp obtained after deslagging is fed into a horizontal belt pulp washer for washing, pulp concentration is 2.0% while washing, the pulp from the pulp washer has concentration of 9%, temperature is kept at 70° C. during the washing process, the pulp is conveyed to a disintegrator for disintegration, beating degree of the giant reed is 24° SR and 27° SR before and after the disintegration, and the pulp is heated to 70° C. by a spiral conveyor and conveyed to a medium-concentration pulp pipe after concentration of the pulp is adjusted to 10%. The pulp is subject to thermal refining in the medium-concentration pulp pipe to eliminate air and to be fluidized and then conveyed to an oxygen delignification reaction tower by a centrifugal medium-concentration pulp pump. The pulp is mixed with added oxygen of 30 kg for 1 t pulp and alkali solution with alkali content being 4% of the bone dry raw material based on sodium hydroxide in the pipe before being fed into the reaction tower and heated by feeding steam to the pipe. Then, the pulp is fully mixed in a mixer and then fed into the oxygen delignification reaction tower, magnesium sulfate is used as a protectant, magnesium sulfate added is 1% of the bone dry raw material, the inlet temperature is 102° C., the inlet pressure is 1.2 Mpa, the condition is kept 90 min to allow the pulp to receive sufficient delignification reaction, temperature is 105° C. and pressure is kept at 0.5 MPa at the top of the tower. The pulp is blown to a pulp chest and diluted to obtain the unbleached pulp after finishing treatment. The unbleached straw pulp has a breaking length of 7.5 km, folding number of 80, tear strength of 280 mN, whiteness of 37% ISO and beating degree of 33° SR.

Up to 50% of the unbleached straw pulp and 50% of unbleached wood pulp by weight are beaten in a cylindrical refiner at beating concentration of 3.8%, beating pressure of 0.20 MPa and beating current of 62 A respectively, and then beaten in a double disc refiner, beating concentration is 3.4%, beating degree is 35° SR and wet weight is 2.2 g for the straw pulp, and beating concentration is 4.5%, beating degree is 19° SR and wet weight is 12 g for the wood pulp. The unbleached wood pulp is that of the prior art.

The beaten pulp is manufactured to obtain the unbleached food wrap paper. The manufacturing comprises manufacturing the finished pulp obtained after beating and is performed in a single round wire, single drying cylinder and single felt toilet paper machine, and the unbleached food wrap paper is obtained after the manufacturing. The unbleached food wrap paper has an basis weight of 60.0 g/m$^2$, thickness of 79.0 μm, smoothness of 47 S for the front side and 39 S for the reverse side, whiteness of 20% ISO, opacity of 97.6%, breaking length of 6.8 km, transverse folding number of 150, transverse tear strength of 600 mN and water content of 5.2%.

EXAMPLE 5

Giant reed and reed are prepared by a hammer crusher at a mass ratio of 1:4 and then filled in hot black liquor at 135° C. into a cooker by a filler at liquor ratio of 1:7, the cooker cover is closed after the cooker is full, cooking liquor at 145° C. is added to the cooker, alkali used is 13% of the bone dry raw material based on sodium hydroxide, anthraquinone added is 0.5% of the bone dry raw material, the black liquor and air in the filler are discharged, pressure is increased to 0.6 MPa, a cooking liquor circulating pump and a tubular heater of the cooker are started to heat the cooking liquor to 155° C., and heating and insulating last 160 min. The hot black liquor is exchanged by diluted black liquor and conveyed to a hot black liquor tank, high-hardness pulp obtained after cooking has hardness of 20 equivalent to 30 Kappa number and beating degree of 15° SR and concentration adjusted to 18% and is conveyed to a disc refiner for disintegration, washed by a conventional washing method, then heated to 70° C. and conveyed to a medium-concentration pulp pipe by a spiral conveyer. The pulp is subject to thermal refining in the medium-concentration pulp pipe to eliminate air and to be fluidized and then conveyed to an oxygen delignification reaction tower by a centrifugal medium-concentration pulp pump. The pulp is mixed with added oxygen of 35 kg for 1 t pulp and alkali solution with alkali content being 2.5% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 1% of the bone dry raw material, the inlet temperature is 100° C., the inlet pressure is 1.2 Mpa, the condition is kept 80 min to allow the pulp to receive sufficient delignification reaction, temperature is 105° C. and pressure is kept at 0.4 MPa at the top of the tower. The pulp is blown to a pulp chest and diluted to obtain the unbleached pulp after finishing treatment. The unbleached straw pulp has a breaking length of 7.0 km, folding number of 60, tear strength of 240 mN, whiteness of 37% ISO and beating degree of 37° SR.

Up to 60% of the unbleached straw pulp and 40% of unbleached wood pulp by weight are prepared and respectively beaten in a cylindrical refiner at beating concentration of 3.8%, beating pressure of 0.20 MPa and beating current of 65 A, and then beaten in a double disc refiner at beating concentration of 3.3%, beating pressure of 0.15 MPa and beating current of 45 A, and the quality standards for finished pulp obtained after beating are as follows: beating degree is 48° SR and wet weight is 2.8 g. The unbleached wood pulp is that of the prior art and has a breaking length of 7 km, tear strength of 1000 mN, whiteness of 20% ISO and folding number above 1000. The unbleached straw pulp has beating degree of 36° SR and wet weight of 2.3 g, and the unbleached wood pulp has beating degree of 20° SR and wet weight of 12 g.

The beaten pulp is mixed evenly and manufactured to obtain the unbleached food wrap paper. The unbleached food wrap paper has an basis weight of 45 g/m$^2$, thickness of 79.0 m, smoothness of 45 S for the front side and 36 S for the reverse side, whiteness of 45% ISO, opacity of 97.6%, breaking length of 5.8 km, transverse folding number of 170, transverse tear strength of 550 mN and water content of 5.3%.

EXAMPLE 6

Giant reed is prepared by a hammer crusher and then put into a spherical digester, cooking liquor is added to the spherical digester, ammonium sulfite added is 9% of the bone dry raw material, anthraquinone added is 0.8%, liquor ratio is 1:4, and the mixture is heated to 110° C. for the first time, insulated at the temperature for 40 min, then relieved for 30 min, heated to 173° C. for 50 min for the second time and insulated for 60 min. High-hardness pulp obtained after cooking has hardness of 20 equivalent to 30.7 Kappa number and beating degree of 12.5° SR and is conveyed to a single spiral press master with variable diameter for extracting the black liquor in the prior art for pressing, and the high-hardness pulp with concentration of 20% obtained after pressing is washed by a conventional washing method, e.g. a pressure washer, then conveyed to a disc disintegrator for disintegration, heated to 70° C. and conveyed to a medium-concentration pulp pipe by a spiral conveyor. The pulp is subject to thermal refining in the medium-concentration pulp pipe to eliminate air and to be fluidized and then conveyed to an oxygen delignification reaction tower by a centrifugal medium-concentration pulp pump. The pulp is mixed with added oxygen of 20 kg for 1 t pulp and alkali solution with alkali content being 4% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 1% of the bone dry raw material, the inlet temperature is 95° C., the inlet pressure is 0.9 Mpa, the condition is kept 70 min to allow the pulp to receive sufficient delignification reaction, temperature is 100° C. and pressure is kept at 0.3 MPa at the top of the tower. The pulp is blown to a pulp chest and diluted to obtain the unbleached pulp after finishing treatment. The unbleached straw pulp has a breaking length of 5.8 km, folding number of 55, tear strength of 260 mN, whiteness of 40% ISO and beating degree of 38° SR.

Up to 55% of the unbleached straw pulp and 45% of unbleached wood pulp by weight are respectively beaten in a double disc refiner, the beating degree of the reed pulp is 3.5% and that of the wood pulp is 4.5%, and quality standards for finished pulp obtained after beating are as follows: beating degree of 35° SR and wet weight of 2.0 g for the reed pulp and beating degree of 20° SR and wet weight of 12 g for the wood pulp. The unbleached wood pulp is unbleached sulfate softwood pulp of the prior art and has a breaking length of 5.0 km, tear strength of 1 100 mN, whiteness of 18% ISO, folding number above 1000 and beating degree of 39° SR.

The beaten pulp is manufactured to obtain the unbleached food wrap paper. The unbleached food wrap paper has an basis weight of 51.5 g/m$^2$, thickness of 75.0 pm, smoothness of 48 S for the front side and 36 S for the reverse side, whiteness of 40% ISO, opacity of 96.8%, breaking length of 3.2 km, transverse folding number of 140, transverse tear strength of 380 mN and water content of 5.8%.

EXAMPLE 7

Cotton stalk is prepared by a hammer crusher and then put into a spherical digester, cooking liquor is added to the spherical digester, alkali used is 8% of the bone dry raw material based on sodium hydroxide, sulfidity is 8%, liquor ratio is 1:2, and the mixture is heated to 110° C. for the first time, insulated at the temperature for 40 min, then relieved for 25 min, heated to 166° C. for 45 min for the second time and insulated for 75 min. High-hardness pulp obtained by cooking has hardness of 22 equivalent to 35 Kappa number and beating degree of 11.6° SR and is conveyed to a deflaker for disintegration and then to a double roll press master for extracting the black liquor in the prior art for pressing, the high-hardness pulp with concentration of 32% obtained after pressing is diluted to 2.5% with black liquor and washed by a conventional washing method after deslagging, concentration of pulp after washing is adjusted to 15%, and then the pulp is heated to 70° C. and conveyed to a medium-concentration pulp pipe by a spiral conveyor. The pulp is subject to thermal refining in the medium-concentration pulp pipe to eliminate air and to be fluidized and then conveyed to an oxygen delignification reaction tower by a centrifugal medium-concentration pulp pump. The pulp is mixed with added oxygen of 20 kg for 1 t pulp and alkali solution with alkali content being 3% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 1% of the bone dry raw material, the inlet temperature is 95° C., the inlet pressure is 0.9 Mpa, the condition is kept 90 min to allow the pulp to receive sufficient delignification reaction, temperature is 100° C. and pressure is kept at 0.4 MPa at the top of the tower. The pulp is blown to a pulp chest and diluted to obtain the unbleached pulp after finishing treatment. The unbleached straw pulp has a breaking length of 4.3 km, folding number of 70, tear strength of 275 mN, whiteness of 42% ISO and beating degree of 34° SR.

Up to 80% of the unbleached straw pulp and 20% of unbleached wood pulp by weight are respectively beaten in a double disc refiner, the beating degree of the cotton stalk is 3.5% and that of the wood pulp is 4.5%, and quality standards for finished pulp obtained after beating are as follows: beating degree of 55° SR and wet weight of 2.0 g for the reed pulp and beating degree of 48° SR and wet weight of 2.6 g for the wood pulp. The unbleached wood pulp is unbleached sulfate softwood pulp of the prior art and has a breaking length of 5.0 km, tear strength of 1100 mN, whiteness of 18% ISO, folding number above 1000 and beating degree of 39° SR.

The beaten pulp is manufactured to obtain the unbleached duplicating paper. The unbleached duplicating paper has an basis weight of 60.0 g/m$^2$, transverse and longitudinal mean breaking length of 4.51 mm, longitudinal stiffness of 112 mN, transverse stiffness of 72 mN and whiteness of 44.7% ISO.

EXAMPLE 8

Rice straw and wheat straw are prepared by a dry method using a hammer crusher at a mass ratio of 1:3 and then put into a spherical digester, cooking liquor is added to the spherical digester, alkali used is 11% of the bone dry raw material based on sodium hydroxide, sulfidity is 5%, liquor ratio is 1:4, and the mixture is heated to 110° C. for the first time, insulated at the temperature for 20 min, then relieved for 30 min, heated to 168° C. for 40 min for the second time and insulated for 90 min High-hardness pulp obtained after cooking has hardness of 19 equivalent to 29 Kappa number and beating degree of 14.3° SR and is conveyed to a conventional single spiral press master with variable diameter for extracting the black liquor for pressing, the pulp from the press master is diluted to 3.0% with diluted black liquor, then conveyed to a hop sieve for coarse pulp screening with hop sieve loss of 0.2% and delagged by a high-concentration slag separator with loss of 0.1%, the pulp obtained after deslagging is fed into a horizontal belt pulp washer for washing, pulp concentration is 3.0% while washing, the pulp from the pulp washer has concentration of 9%, temperature is kept at 70° C. during the washing process, and the pulp is conveyed to a deflaker for disintegration, the pulp is subject to thermal refining in a medium-concentration pulp pipe to eliminate air and to be fluidized and then conveyed to an oxygen delignification reaction tower by a centrifugal medium-concentration pulp pump. The pulp is mixed with added oxygen of 20 kg for 1 t pulp and alkali solution with alkali content being 4% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 1% of the bone dry raw material, the inlet temperature is 95° C., the inlet pressure is 0.9 Mpa, the condition is kept 75 min to allow the pulp to receive sufficient delignification reaction, temperature is 100° C. and pressure is kept at 0.3 MPa at the top of the tower. The pulp is blown to a pulp chest and diluted to obtain the unbleached pulp after finishing treatment. The unbleached straw pulp has a breaking length of 7.2 km, folding number of 45, tear strength of 250 mN, whiteness of 42% ISO and beating degree of 33° SR.

Up to 50% of the unbleached straw pulp and 50% of unbleached wood pulp by weight are respectively beaten in a cylindrical refiner at beating concentration of 3.8%, beating pressure of 0.20 MPa and beating current of 62 A, and then beaten in a double disc refiner at beating concentration of 3.4%, beating pressure of 0.20 MPa and beating current of 60 A, and quality standards for the finished pulp after beating are as follows: beating degree of 48° SR and wet weight of 3.2 g. The unbleached wood pulp is that of the prior art, comprises unbleached sulfate softwood pulp, unbleached sulfite softwood pulp, etc. and has a breaking length of 6.5 km, tear strength of 1000 mN, whiteness of 20% ISO, folding number above 1000 and beating degree of 38° SR.

The beaten pulp is manufactured to obtain the unbleached duplicating paper. The unbleached duplicating paper has an basis weight of 65.0 g/m$^2$, transverse and longitudinal mean breaking length of 7.5 km, longitudinal stiffness of 82 mN, transverse stiffness of 55 mN and whiteness of 41.8% ISO.

EXAMPLE 9

Rice straw is prepared by a dry method using a hammer crusher and then put into a spherical digester, cooking liquor is added to the spherical digester, alkali used is 15% of the bone dry raw material based on sodium hydroxide, liquor ratio is 1:3, anthraquinone added is 0.6% of the bone dry raw material, and the mixture is heated to 120° C. for the first time, insulated at the temperature for 20 min, then relieved for 20-30 min, heated to 168° C. for 40 min for the second time and insulated for 90 min. High-hardness pulp obtained after cooking has hardness of 18 equivalent to 27 Kappa number and beating degree of 17° SR and is conveyed to a conventional single spiral press master with variable diameter for extracting the black liquor for pressing, the pulp from the press master is diluted to 2.5% with diluted black liquor, then conveyed to a hop sieve for coarse pulp screening with hop sieve loss of 0.2% and delagged by a high-concentration slag separator with loss of 0.1%, the pulp obtained after deslagging is fed into a horizontal belt pulp washer for washing, pulp concentration is 3.0% while washing, the pulp from the pulp washer has concentration of 9%, temperature is kept at 68-70° C. during the washing process, and the pulp is conveyed to a deflaker for disintegration, heated to 70° C. and conveyed to a medium-concentration pulp pipe by a spiral conveyor after adjusting concentration. The pulp is subject to thermal refining in the medium-concentration pulp pipe to eliminate air and to be fluidized and then conveyed to an oxygen delignification reaction tower by a centrifugal medium-concentration pulp pump. The pulp is mixed with added oxygen of 20 kg for 1 t pulp and alkali solution with alkali content being 4% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 1% of the bone dry raw material, the inlet temperature is 102° C., the inlet pressure is 1.12 Mpa, the condition is kept 70 min to allow the pulp to receive sufficient delignification reaction, temperature is 104° C. and pressure is kept at 0.5 MPa at the top of the tower. The pulp is blown to a pulp chest and diluted to obtain the unbleached pulp after finishing treatment. The unbleached straw pulp has a breaking length of 4.4 km, folding number of 65, tear strength of 245 mN, whiteness of 37% ISO and beating degree of 34° SR.

Up to 70% of the unbleached straw pulp and 30% of unbleached wood pulp by weight are respectively beaten in a double disc refiner, the beating concentration of the straw pulp is 3.2% and that of the wood pulp is 4.5%, and quality standards for finished pulp obtained after beating are as follows: beating degree of 55° SR and wet weight of 2.0 g for the straw pulp and beating degree of 48 ° SR and wet weight of 2.0 g for the wood pulp. The unbleached wood pulp is unbleached sulfate hardwood pulp of the prior art.

The beaten pulp is manufactured to obtain the unbleached duplicating paper.

The unbleached duplicating paper has an basis weight of 72.0 g/m$^2$, transverse and longitudinal mean breaking length of 6.2 km, longitudinal stiffness of 90 mN, transverse stiffness of 56 mN and whiteness of 35.0% ISO.

EXAMPLE 10

Rice straw and wheat straw are prepared by a dry method using a hammer crusher at a mass ratio of 1:3 and then put into a spherical digester, cooking liquor is added to the spherical digester, alkali used is 11% of the bone dry raw material based on sodium hydroxide, sulfidity is 5%, liquor ratio is 1:4, and the mixture is heated to 110° C. for the first time, insulated at the temperature for 20 min, then relieved for 30 min, heated to 168° C. for 40 min for the second time and insulated for 90 min.

High-hardness pulp obtained after cooking has hardness of 19 equivalent to 29 Kappa number and beating degree of 14.3° SR and is conveyed to a conventional single spiral press master with variable diameter for extracting the black liquor for pressing, the pulp from the press master is diluted to 3.0% with diluted black liquor, then conveyed to a hop sieve for coarse pulp screening with hop sieve loss of 0.2% and delagged by a high-concentration slag separator with loss of 0.1%, the pulp obtained after deslagging is fed into a horizontal belt pulp washer for washing, pulp concentration is 3.0% while washing, the pulp from the pulp washer has concentration of 9%, temperature is kept at 70° C. during the washing process, and the pulp is conveyed to a deflaker for disintegration, the pulp is subject to thermal refining in a medium-concentration pulp pipe to eliminate air and to be fluidized and then conveyed to an oxygen delignification reaction tower by a centrifugal medium-concentration pulp pump. The pulp is mixed with added oxygen of 20 kg for 1 t pulp and alkali solution with alkali content being 4% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 1% of the bone dry raw material, the inlet temperature is 95° C., the inlet pressure is 0.9 Mpa, the condition is kept 75 min to allow the pulp to receive sufficient delignification reaction, temperature is 100° C. and pressure is kept at 0.3 MPa at the top of the tower. The pulp is blown to a pulp chest and diluted to obtain the unbleached pulp after finishing treatment. The unbleached straw pulp has a breaking length of 7.2 km, folding number of 45, tear strength of 250 mN, whiteness of 42% ISO and beating degree of 33° SR.

The unbleached straw pulp is beaten at the beating degree of 30° SR with wet weight of 2.3 g.

The beaten pulp is mixed evenly and the subject to post-treatment to obtain the unbleached lunch box. The post-treatment comprises adding 1.1% of an oil proofing agent, 3.3% of a water repellent and 0.15% of a catcher and drying at 0.055 MP and 180° C. for 75 s. The obtained unbleached lunch box completely meets requirements for Grade A products in GB 18006.1-1999.

EXAMPLE 11

Rice straw is prepared by a dry method using a hammer crusher and then put into a spherical digester, cooking liquor is added to the spherical digester, alkali used is 15% of the bone dry raw material based on sodium hydroxide, liquor ratio is 1:3, anthraquinone added is 0.6% of the bone dry raw material, and the mixture is heated to 120° C. for the first time, insulated at the temperature for 20 min, then relieved for 20-30 min, heated to 168° C. for 40 min for the second time and insulated for 90 min. High-hardness pulp obtained after cooking has hardness of 18 equivalent to 27 Kappa number and beating degree of 17° SR and is conveyed to a conventional single spiral press master with variable diameter for extracting the black liquor for pressing, the pulp from the press master is diluted to 2.5% with diluted black liquor, then conveyed to a hop sieve for coarse pulp screening with hop sieve loss of 0.2% and delagged by a high-concentration slag separator with loss of 0.1%, the pulp obtained after deslagging is fed into a horizontal belt pulp washer for washing, pulp concentration is 3.0% while washing, the pulp from the pulp washer has concentration of 9%, temperature is kept at 68-70° C. during the washing process, and the pulp is conveyed to a deflaker for disintegration, heated to 70° C. and conveyed to a medium-concentration pulp pipe by a spiral conveyor after adjusting concentration. The pulp is subject to thermal refining in a medium-concentration pulp pipe to eliminate air and to be fluidized and then conveyed to an oxygen delignification reaction tower by a centrifugal medium-concentration pulp pump. The pulp is mixed with added oxygen of 20 kg for 1 t pulp and alkali solution with alkali content being 4% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 1% of the bone dry raw material, the inlet temperature is 102° C., the inlet pressure is 1.12 Mpa, the condition is kept 70 min to allow the pulp to receive sufficient delignification reaction, temperature is 104° C. and pressure is kept at 0.5 MPa at the top of the tower. The pulp is blown to a pulp chest and diluted to obtain the unbleached pulp after finishing treatment. The unbleached pulp has a breaking length of 4.4 km, folding number of 65, tear strength of 245 mN, whiteness of 37% ISO and beating degree of 34° SR.

Up to 70% of the unbleached straw pulp and 30% of unbleached wood pulp are respectively beaten, the beating degree is 31° SR and wet weight is 2.2 g for the unbleached straw pulp, and the beating degree is 20° SR and wet weight is 10 g for the unbleached wood pulp.

The beaten pulp is mixed evenly and subject to post-treatment to obtain the unbleached lunch box. The post-treatment comprises adding 1.1% of an oil proofing agent, 3.3% of a water repellent and 0.15% of a catcher and drying at 0.05 MP and 178° C. for 78 s. The obtained unbleached lunch box completely meets requirements for Grade A products in GB 18006.1-1999.

EXAMPLE 12

Giant reed is prepared by a conventional dry method using a hammer crusher and then put into a spherical digester, cooking liquor is added to the spherical digester, alkali used is 11% of the bone dry raw material based on sodium hydroxide, anthraquinone added is 0.8%, liquor ratio is 1:4, and the mixture is heated to 130° C. for the first time, insulated at the temperature for 40 min, then relieved for 30 min, heated to 173° C. for 60 min for the second time and insulated for 60 min. High=hardness pulp obtained after cooking has hardness of 25 equivalent to 45 Kappa number and beating degree of 12° SR and is conveyed to a single spiral press master with variable diameter for extracting the black liquor in the prior art for pressing, the high-hardness pulp with concentration of 20% obtained after pressing is conveyed to a hop sieve for coarse pulp screening with hop sieve loss of 0.2% and delagged by a high-concentration slag separator with loss of 0.1%, the pulp obtained after deslagging is fed into a horizontal belt pulp washer for washing, pulp concentration is 2.0% while washing, the pulp from the pulp washer has concentration of 9%, temperature is kept at 68-70° C. during the washing process, and the pulp is heated to 70° C. and conveyed to a medium-concentration pulp pipe by a spiral conveyor after adjusting concentration. The pulp is subject to thermal refining in a medium-concentration pulp pipe to eliminate air and to be fluidized and then conveyed to an oxygen delignification reaction tower by a centrifugal medium-concentration pulp pump. The pulp is mixed with added oxygen of 20 kg for it pulp and alkali solution with alkali content being 4% of the bone dry raw material based on sodium hydroxide in the pipe and heated by feeding steam to the pipe before being fed into the reaction tower. Then, the pulp is fully mixed in a mixer and then fed into an oxygen delignification reaction tower, magnesium sulfate is used as a protectant, magnesium sulfate added is 1% of the bone dry raw material, the inlet temperature is 102° C., the inlet pressure is 1.12 Mpa, the condition is kept 75 min to allow the pulp to receive sufficient delignification reaction, temperature is 104° C. and pressure is kept at 0.5 MPa at the top of the tower. The pulp is blown to a pulp chest and diluted to obtain the unbleached pulp after finishing treatment. The unbleached straw pulp has a breaking length of 5.0 km, folding number of 69, tear strength of 255 mN, whiteness of 42% ISO and beating degree of 33° SR.

Up to 70% of the unbleached straw pulp and 30% of unbleached wood pulp are respectively beaten, the beating degree is 32° SR and wet weight is 2.3 g for the unbleached straw pulp, and the beating degree is 20° SR and wet weight is 12 g for the unbleached wood pulp.

The beaten pulp is mixed evenly and subject to post-treatment to obtain the unbleached lunch box. The post-treatment comprises adding 1.2% of an oil proofing agent, 3% of a water repellent and 0.15% of a catcher and drying at 0.055 MP and 175° C. for 80 s.

The obtained unbleached lunch box completely meet requirements for Grade A products in GB 18006.1-1999.

EXAMPLE 13

Wheat straw material is prepared by a hammer crusher and then put into a spherical digester, cooking liquor is added to the spherical digester, ammonium sulfite added is 9% of the bone dry raw material, liquor ratio is 1:3, and the mixture is heated to 110° C. for the first time, insulated at the temperature for 30 min, then relieved for 25 min, heated to 168° C. for 60 min for the second time and insulated for 90 min. The high-hardness pulp obtained after cooking has hardness of 22 equivalent to 35.5 Kappa number and beating degree of 11.6° SR and is diluted to 2.5% with diluted black liquor and then screened by a screening method in the prior art, for example, hop screening method with loss of 0.5%.The high-hardness pulp is washed by a vacuum pulp washer in the prior art. The high-hardness pulp with concentration of 10% obtained after washing is conveyed to a medium-concentration pulp pipe. The high-hardness pulp is conveyed to an oxygen delignification reaction tower via a medium-concentration pulp pump. The pulp is mixed with added oxygen of 20 kg for 1 t pulp and alkali solution with alkali content being 4% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 1% of the bone dry raw material, the inlet temperature is 95° C., the inlet pressure is 0.9 Mpa, the condition is kept 75 min to allow the pulp to receive sufficient delignification reaction, temperature is 100° C. and pressure is kept at 0.3 MPa at the top of the tower. The pulp is blown to a pulp chest and diluted to obtain the unbleached pulp after finishing treatment. The unbleached straw pulp has a breaking length of 5.0 km, folding number of 40, tear strength of 220 mN, whiteness of 40% ISO and beating degree of 34° SR. The unbleached straw pulp is beaten, and quality standards for the finished pulp obtained after beating are as follows: beating degree of 45° SR and wet weight of 2.8 g.

The beaten pulp is manufactured to obtain the unbleached towel paper. The manufacturing is performed in a single cylinder and long wire paper machine.

The unbleached towel paper has an basis weight of 23.0 g/m$^2$, transverse suction range of 66 mm/100 s, longitudinal wet tensile strength of 36 N/m and whiteness of 41.5% ISO.

EXAMPLE 14

Rice straw material is prepared by a dry method using a hammer crusher and then put into a spherical batch cooker, cooking liquor is added to the spherical batch cooker, ammonium sulfite added is 13% of the bone dry raw material, liquor ratio is 1:4, and the mixture is heated to 120° C. for the first time, insulated at the temperature for 40 min, then relieved for 25 min, heated to 168° C. for 60 min for the second time and insulated for 90 min. The high-hardness pulp obtained after cooking has hardness of 16 equivalent to 23 Kappa number and beating degree of 23.4° SR and is diluted to 2.5% with diluted black liquor and then screened by a screening method in the prior art, for example, hop screening method with loss of 0.2%. The high-hardness pulp is washed by a vacuum pulp washer in the prior art. The high-hardness pulp with concentration of 10% obtained after washing is heated to 70° C. and conveyed to a medium-concentration pulp pipe by a spiral conveyer. The pulp is subject to thermal refining in a medium-concentration pulp pipe to eliminate air and to be fluidized and then conveyed to an oxygen delignification reaction tower by a centrifugal medium-concentration pulp pump. The pulp is mixed with added oxygen of 20 kg for 1 t pulp and alkali solution with alkali content being 3.5% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 1% of the bone dry raw material, the inlet temperature is 95° C., the inlet pressure is 0.9 Mpa, the condition is kept 75 min to allow the pulp to receive sufficient delignification reaction, temperature is 100° C. and pressure is kept at 0.4 MPa at the top of the tower. The pulp is blown to a pulp chest and diluted to obtain the unbleached pulp after finishing treatment. The unbleached straw pulp has a breaking length of 6.8 km, folding number of 50, tear strength of 250 mN, whiteness of 45% ISO and beating degree of 36° SR.

Up to 70% of the unbleached straw pulp and 30% of unbleached wood pulp by weight are beaten at the beating concentration of 3.0% and 4.5% respectively in a double disc refiner, and quality standards for finished pulp obtained after beating are as follows: beating degree of 50° SR and wet weight of 1.8 g for the straw pulp and beating degree of 46° SR and wet weight of 1.2 g for the wood pulp. The unbleached hardwood pulp has a breaking length of 6.5 km, tear strength of 1000 mN, whiteness of 18% ISO, folding number of 1000 and beating degree of 38° SR.

The beaten pulp is mixed evenly and manufactured to obtain the unbleached towel paper. The manufacturing is performed in a double cylinder and long wire paper machine The unbleached towel paper has an basis weight of 38.2 g/m$^2$, transverse suction range of 60 mm/100 s, longitudinal wet tensile strength of 30 N/m and whiteness of 38% ISO.

EXAMPLE 15

Bagasse material is prepared conventionally by a dry method, has pith removed and then is put into a spherical digester, cooking liquor is added to the spherical digester, ammonium sulfite added is 11% of the bone dry raw material, liquor ratio is 1:2.5, and the mixture is heated to 130° C. for the first time, insulated at the temperature for 20 min, then relieved for 20 min, heated to 165° C. for 50 min for the second time and insulated for 70 min. High-hardness pulp obtained by cooking has hardness of 21 equivalent to 32 Kappa number and beating degree of 14.2° SR and is conveyed to a double spiral press master for extracting the black liquor in the prior art for pressing, the high-hardness pulp with concentration of 25% obtained after pressing is diluted to 2.5% with black liquor and then conveyed to a vacuum pulp washer for washing, and the obtained pulp is heated to 70° C. and conveyed to a medium-concentration pulp pipe by a spiral conveyor after concentration of the pulp reaches 10-13%. The pulp is subject to thermal refining in a medium-concentration pulp pipe to eliminate air and to be fluidized and then conveyed to an oxygen delignification reaction tower by a centrifugal medium-concentration pulp pump. The pulp is mixed with added oxygen of 30 kg for it pulp and alkali solution with alkali content being 3% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 0.8% of the bone dry raw material, the inlet temperature is 98° C., the inlet pressure is 1.05 Mpa, the condition is kept 85 min to allow the pulp to receive sufficient delignification reaction, temperature is 102° C. and pressure is kept at 0.4 MPa at the top of the tower. The pulp is blown to a pulp chest and diluted to obtain the unbleached pulp after finishing treatment. The unbleached straw pulp has a breaking length of 6.0 km, folding number of 70, tear strength of 230 mN, whiteness of 40% ISO and beating degree of 35° SR.

Up to 80% of the unbleached straw pulp and 20% of unbleached wood pulp by weight are beaten at the beating concentration of 3.2% and 4.0% respectively in a double cylinder refiner and then in a double disc refiner, and quality standards for finished pulp obtained after beating are as follows: beating degree of 50° SR and wet weight of 1.8 g for the straw pulp and beating degree of 41° SR and wet weight of 1.5 g for the hardwood pulp. The unbleached wood pulp is that of the prior art, comprises unbleached sulfate softwood pulp, unbleached sulfite softwood pulp, etc. and has a breaking length of 4.5 km, tear strength of 500 mN, whiteness of 18% ISO, folding number of 1000 and beating degree of 38° SR.

The beaten pulp is mixed evenly and manufactured to obtain the unbleached towel paper. The manufacturing is performed in a single cylinder and inclined wire paper machine. The unbleached towel paper has an basis weight of 45.0 g/m$^2$, transverse suction range of 55 mm/100 s, longitudinal wet tensile strength of 28 N/m and whiteness of 41% ISO.

EXAMPLE 16

Rice straw is prepared by a dry method using a hammer crusher and then put into a spherical digester, cooking liquor is added to the spherical digester, alkali used is 15% of the bone dry raw material based on sodium hydroxide, liquor ratio is 1:3, anthraquinone added is 0.6% of the bone dry raw material, and the mixture is heated to 120° C. for the first time, insulated at the temperature for 20 min, then relieved for 20-30 min, heated to 168° C. for 40 min for the second time and insulated for 90 min. High-hardness pulp obtained after cooking has hardness of 18 equivalent to 27 Kappa number and beating degree of 17° SR and is conveyed to a conventional single spiral press master with variable diameter for extracting the black liquor for pressing, the pulp from the press master is diluted to 2.5% with diluted black liquor, then conveyed to a hop sieve for coarse pulp screening with hop sieve loss of 0.2% and delagged by a high-concentration slag separator with loss of 0.1%, the pulp obtained after deslagging is fed into a horizontal belt pulp washer for washing, pulp concentration is 3.0% while washing, the pulp from the pulp washer has concentration of 9%, temperature is kept at 68-70° C. during the washing process, and the pulp is conveyed to a deflaker for disintegration, heated to 70° C. and conveyed to a medium-concentration pulp pipe by a spiral conveyor after adjusting concentration. The pulp is subject to thermal refining in a medium-concentration pulp pipe to eliminate air and to be fluidized and then conveyed to an oxygen delignification reaction tower by a centrifugal medium-concentration pulp pump. The pulp is mixed with added oxygen of 20 kg for 1 t pulp and alkali solution with alkali content being 4% of the bone dry raw material based on sodium hydroxide in the pipe in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 1% of the bone dry raw material, the inlet temperature is 102° C., the inlet pressure is 1.12 Mpa, the condition is kept 70 min to allow the pulp to receive sufficient delignification reaction, temperature is 104° C. and pressure is kept at 0.5 MPa at the top of the tower.

The pulp is blown to a pulp chest and diluted to obtain the unbleached pulp after finishing treatment. The unbleached straw pulp has a breaking length of 4.4 km, folding number of 65, tear strength of 245 mN, whiteness of 37% ISO and beating degree of 34° SR.

Up to 95% of the unbleached straw pulp and 5% of unbleached wood pulp by weight are respectively beaten in a double disc refiner, the beating concentration of the straw pulp is 3.2% and that of the wood pulp is 4.5%, and quality standards for finished pulp obtained after beating are as follows: beating degree of 55° SR and wet weight of 2.0 g for the straw pulp and beating degree of 48° SR and wet weight of 2.0 g for the wood pulp. The unbleached wood pulp is unbleached sulfate hardwood pulp of the prior art.

The beaten pulp is mixed evenly and manufactured to obtain the unbleached toilet paper.

The unbleached towel paper has an basis weight of 18.0 g/m$^2$, transverse suction range of 60 mm/100 s, tensile index of 7.0 N.m/g, softness of 130 mN and whiteness of 50% ISO.

EXAMPLE 17

Giant reed is prepared by a conventional dry method and then put into a spherical digester, cooking liquor is added to the spherical digester, alkali used is 11% of the bone dry raw material based on sodium hydroxide, anthraquinone added is 0.8%, liquor ratio is 1:4, the mixture is heated to 130° C. for the first time, insulated at the temperature for 40 min, then relieved for 30 min, heated to 173° C. for 60 min for the second time and insulated for 60 min. High-hardness pulp obtained after cooking has hardness of 25 equivalent to 45 Kappa number and beating degree of 12° SR and is conveyed to a single spiral press master with variable diameter for extracting the black liquor in the prior art for pressing, the high-hardness pulp with concentration of 20% obtained after pressing is conveyed to a hop sieve for coarse pulp screening with hop sieve loss of 0.2% and delagged by a high-concentration slag separator with loss of 0.1%, the pulp obtained after deslagging is fed into a horizontal belt pulp washer for washing, pulp concentration is 2.0% while washing, the pulp from the pulp washer has concentration of 9%, temperature is kept at 68-70° C. during the washing process, and the pulp is heated to 70° C. and conveyed to a medium-concentration pulp pipe by a spiral conveyor after adjusting concentration. The pulp is subject to thermal refining in a medium-concentration pulp pipe to eliminate air and to be fluidized and then conveyed to an oxygen delignification reaction tower by a centrifugal medium-concentration pulp pump. The pulp is mixed with added oxygen of 20 kg for 1 t pulp and aqueous alkali with alkali content being 4% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 1% of the bone dry raw material, the inlet temperature is 102° C., the inlet pressure is 1.12 Mpa, the condition is kept 75 min to allow the pulp to receive sufficient delignification reaction, temperature is 104° C. and pressure is kept at 0.5 MPa at the top of the tower. The pulp is blown to a pulp chest and diluted to obtain the unbleached pulp after finishing treatment. The unbleached straw pulp has a breaking length of 5.0 km, folding number of 69, tear strength of 255 mN, whiteness of 42% ISO and beating degree of 33° SR.

Up to 70% of the unbleached straw pulp and 30% of unbleached wood pulp by weight are respectively beaten in a cylindrical refiner at beating concentration of 3.8%, beating pressure of 0.15-0.20 MPa and beating current of 65 A, and then beaten in a double disc refiner at beating concentration of 3.3%, beating pressure of 0.20 MPa and beating current of 60 A, and quality standards for the finished pulp after beating are as follows: beating degree of 48° SR and wet weight of 2.8 g. The unbleached wood pulp is that of the prior art, comprises unbleached sulfate softwood pulp, unbleached sulfite softwood pulp, etc. and has a breaking length of 6 km, tear strength of 1000 mN, whiteness of 18% ISO, folding number above 1000 and beating degree of 40° SR.

The beaten pulp is manufactured to obtain the unbleached toilet paper.

The unbleached toilet paper has an basis weight of 11.0 g/m$^2$, transverse suction range of 80 mm/100 s, tensile index of 10.0 N.m/g, softness of 120 mN and whiteness of 38% ISO.

EXAMPLE 18

Rice straw, wheat straw and reed are prepared by a dry method using a hammer crusher at a mass ratio of 1:3:1 and then filled in hot black liquor at 135° C. into a cooker by a filler at liquor ratio of 1:8, the cooker cover is closed after the cooker is full, cooking liquor at 145° C. is added to the cooker, alkali used is 11% of the bone dry raw material based on sodium hydroxide, anthraquinone added is 0.8% of the bone dry raw material, the black liquor and air in the filler is discharged, pressure is increased to 0.6 MPa, a cooking liquor circulating pump and a tubular heater of the cooker are started to heat the cooking liquor to 160° C., and heating and insulating last 180 min. The hot black liquor is exchanged by diluted black liquor and conveyed to a hot black liquor tank, high-hardness pulp obtained after cooking has hardness of 19 equivalent to 29 Kappa number and beating degree of 16° SR and is conveyed to a conventional single spiral press master with variable diameter for extracting the black liquor for pressing, the pulp from the press master is diluted to 3.0% with diluted black liquor, then conveyed to a hop sieve for coarse pulp screening with hop sieve loss of 0.2% and delagged by a high-concentration slag separator with loss of 0.1%, the pulp obtained after deslagging is fed into a horizontal belt pulp washer for washing, pulp concentration is 3.0% while washing, the pulp from the pulp washer has concentration of 9%, temperature is kept at 70° C. during the washing process, the pulp is conveyed to a deflaker for disintegration, and the pulp is subject to thermal refining in a medium-concentration pulp pipe to eliminate air and to be fluidized and then conveyed to an oxygen delignification reaction tower by a centrifugal medium-concentration pulp pump. The pulp is mixed with added oxygen of 20 kg for 1 t pulp and aqueous alkali with alkali content being 4% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 1% of the bone dry raw material, the inlet temperature is 95° C., the inlet pressure is 0.9 Mpa, the condition is kept 75 min to allow the pulp to receive sufficient delignification reaction, temperature is 100° C. and pressure is kept at 0.4 MPa at the top of the tower. The pulp is blown to a pulp chest and diluted to obtain the unbleached pulp after finishing treatment. The unbleached straw pulp has a breaking length of 6.5 km, folding number of 45, tear strength of 250 mN, whiteness of 42% ISO and beating degree of 33° SR.

Up to 95% of the unbleached straw pulp and 5% of unbleached wood pulp by weight are respectively beaten in a double disc refiner at the beating concentration of 3.4%, and quality standards for finished pulp obtained after beating are as follows: beating degree of 48° SR and wet weight of 2.9 g. The unbleached wood pulp is that of the prior art, comprises unbleached sulfate softwood pulp, unbleached sulfite softwood pulp, etc. and has a breaking length of 6 km, tear strength of 1000 mN, whiteness of 20% ISO, folding number above 1000 and beating degree of 38° SR.

The beaten pulp is manufactured to obtain the unbleached toilet paper.

The unbleached towel paper has an basis weight of 13.0 g/m$^2$, transverse suction range of 30 mm/100 s, longitudinal wet tensile strength of 22 N/m, softness of 140 mN and whiteness of 50% ISO.

EXAMPLE 19

Wheat straw is prepared by a hammer crusher and then put into a spherical digester, cooking liquor is added to the spherical digester, ammonium sulfite added is 9% of the bone dry raw material, liquor ratio is 1:3, the wheat straw material is heated to 110° C. for the first time, insulated at the temperature for 30 min, then relieved for 25 min, heated to 168° C. for 60 min for the second time and insulated for 90 min. The high-hardness pulp obtained after cooking has hardness of 22 equivalent to 35.5 Kappa number and beating degree of 11.6° SR and is diluted to 2.5% with diluted black liquor and then screened by a screening method in the prior art, for example, hop screening method with loss of 0.5%. The high-hardness pulp is washed by a vacuum pulp washer in the prior art. The high-hardness pulp with concentration of 10% obtained after washing is conveyed to a medium-concentration pulp pipe. The high-hardness pulp is conveyed to an oxygen delignification reaction tower via a medium-concentration pulp pump. The pulp is mixed with added oxygen of 20 kg for 1 t pulp and aqueous alkali with alkali content being 4% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 1% of the bone dry raw material, the inlet temperature is 95° C., the inlet pressure is 0.9 Mpa, the condition is kept 75 min to allow the pulp to receive sufficient delignification reaction, temperature is 100° C. and pressure is kept at 0.3 MPa at the top of the tower. The pulp is blown to a pulp chest and diluted to obtain the unbleached pulp after finishing treatment. The unbleached straw pulp has a breaking length of 5.0 km, folding number of 40, tear strength of 220 mN, whiteness of 40% ISO and beating degree of 34° SR. The unbleached straw pulp is beaten, and quality standards for the finished pulp obtained after beating are as follows: beating degree of 45° SR and wet weight of 2.8 g.

The beaten pulp is manufactured to obtain the unbleached wiping paper. The manufacturing is performed in a single cylinder and long wire paper machine The unbleached wiping paper has an basis weight of 14.0 g/m$^2$, transverse suction range of 100 mm/100 s, longitudinal wet tensile strength of 55 N/m and whiteness of 45% ISO.

EXAMPLE 20

Wheat straw is prepared by a dry method using a hammer crusher and then put into a spherical batch cooker, cooking liquor is added to the spherical batch cooker, ammonium sulfite added is 13% of the bone dry raw material, liquor ratio is 1:4, the mixture is heated to 120° C. for the first time, insulated at the temperature for 40 min, then relieved for 25 min, heated to 168° C. for 60 min for the second time and insulated for 90 min. The high-hardness pulp obtained after cooking has hardness of 16 equivalent to 23 Kappa number and beating degree of 23.4° SR and is diluted to 2.5% with diluted black liquor and then screened by a screening method in the prior art, for example, hop screening method with loss of 0.2%. The high-hardness pulp is washed by a vacuum pulp washer in the prior art. The high-hardness pulp with concentration of 10% obtained after washing is heated to 70° C. and conveyed to a medium-concentration pulp pipe by a spiral conveyer.

The pulp is subject to thermal refining in a medium-concentration pulp pipe to eliminate air and to be fluidized and then conveyed to an oxygen delignification reaction tower by a centrifugal medium-concentration pulp pump. The pulp is mixed with added oxygen of 20 kg for 1 t pulp and aqueous alkali with alkali content being 3.5% of the bone dry raw material based on sodium hydroxide in the pipe and heated by feeding steam to the pipe before being fed into the reaction tower. Then, the pulp is fully mixed in a mixer and then fed into the oxygen delignification reaction tower, magnesium sulfate is used as a protectant, magnesium sulfate added is 1% of the bone dry raw material, the inlet temperature is 95° C., the inlet pressure is 0.9 Mpa, the condition is kept 75 min to allow the pulp to receive sufficient delignification reaction, temperature is 100° C. and pressure is kept at 0.4 MPa at the top of the tower. The pulp is blown to a pulp chest and diluted to obtain the unbleached pulp after finishing treatment. The unbleached pulp has a breaking length of 6.81 cm, folding number of 50, tear strength of 250 mN, whiteness of 45% ISO and beating degree of 36° SR.

Up to 70% of the unbleached straw pulp and 30% of unbleached wood pulp by weight are beaten in a double disc refiner at the beating concentration of 3.0% and 4.5% respectively, and quality standards for finished pulp obtained after beating are as follows: beating degree of 50° SR and wet weight of 1.8 g for the straw pulp and beating degree of 46° SR and wet weight of 1.2 g for the wood pulp. The unbleached hardwood pulp has a breaking length of 6.5 km, tear strength of 1000 mN, whiteness of 18% ISO, folding number of 1000 and beating degree of 38° SR.

The beaten pulp is mixed evenly and manufactured to obtain the unbleached wiping paper. The manufacturing is performed in a double cylinder and long wire paper machine. The unbleached wiping paper has an basis weight of 36.0 g/m$^2$, transverse suction range of 60 mm/100 s, longitudinal wet tensile strength of 40 N/m and whiteness of 45% ISO.

The invention claimed is:

1. A method for preparing an unbleached paper product prepared from cereal straw pulp as a raw material, wherein the method comprises:

preparing the cereal straw material before cooking, including:

cutting and rubbing the cereal straw material to obtain a cut and rubbed material;

dedusting the cut and rubbed material; and screening the dedusted material;

(1) cooking the cereal straw material, pressing, washing, disintegration and then performing oxygen delignification treatment to obtain an unbleached straw pulp;

wherein the oxygen delignification includes:

pumping pulp with a potassium permanganate number of 16-28 obtained after cooking to an oxygen delignification reaction tower and adding sodium hydroxide and oxygen; and allowing delignification reaction of the pulp in an oxygen delignification reaction tower to obtain pulp with a hardness having a potassium permanganate number of 10-14;

the oxygen delignification being single stage and executed in the oxygen delignification reaction tower, the pulp being at 95-100° C. and a pressure of 0.9-1.2 MPa at an inlet of the reaction tower and at 100-105° C. and a pressure of 0.2-0.6 MPa at an outlet, alkali used in the oxygen deliqnification treatment being 2-4% of bone dry pulp based on sodium hydroxide, and oxygen added being 20-40 kg for every ton of bone dry pulp, and the pulp reacting in the reaction tower for 60-90 min;

(2) beating the unbleached straw pulp and an unbleached wood pulp respectively to obtain beaten pulps;

(3) mixing the beaten unbleached straw pulp and the beaten unbleached wood pulp in step (2) based on parts by weight as required by the paper product, and blending the pulp even; and (4) manufacturing with the beaten pulps to obtain the unbleached paper product, wherein the cooking is an ammonium sulfite cooking method in a vertical cooker including:

adding cooking liquor to the cereal straw material, in which ammonium sulfite used is 9-15% of a bone dry raw material, and a liquor ratio is 1:6-10; and filling the cereal straw material in hot black liquor in the cooker by a filler, closing a cooker cover after the cooker is full, supplementing the cooking liquor at 130-145° C. while discharging air from the cooker and boosting a pressure to 0.6-0.75 MPa, and heating the cooking liquor to 156-173° C. in which a time for heating, insulating and exchanging is 220 min; and pumping the pulp to a blow tank.

2. The method for preparing the unbleached paper product according to claim 1, wherein the cooking step comprises obtaining a pulp with a potassium permanganate number of 16-28 and beating degree of 10-24° SR after cooking cereal straw plants as the raw material.

3. The method for preparing the unbleached paper product according to claim 2, wherein the unbleached straw pulp is a pulp with a potassium permanganate number of 16-23 and beating degree of 10-24° SR after cooking cereal straw as the raw material.

4. The method for preparing the unbleached paper product according to claim 1, wherein the disintegration comprises:

treating the pulp obtained after washing by deflaker, rubbing machine, disc crusher, disc refiner or defibering machine of beating machine, to loosen the fiber.

5. A method for preparing an unbleached paper product prepared from cereal straw pulp as a raw material, wherein the method comprises:

preparing the cereal straw material before cooking, including:

cutting and rubbing the cereal straw material to obtain a cut and rubbed material;

dedusting the cut and rubbed material; and screening the dedusted material;

(1) cooking the cereal straw material, pressing, washing, disintegration and then performing oxygen delignification treatment to obtain an unbleached straw pulp;

wherein the oxygen delignification includes:

pumping pulp with a potassium permanganate number of 16-28 obtained after cooking to an oxygen delignification reaction tower and adding sodium hydroxide and oxygen; and allowing delignification reaction of the pulp in an oxygen delignification reaction tower to obtain pulp with a hardness having a potassium permanganate number of 10-14;

the oxygen delignification being single stage and executed in the oxygen delignification reaction tower, the pulp being at 95-100° C. and a pressure of 0.9-1.2 MPa at an inlet of the reaction tower and at 100-105° C. and a pressure of 0.2-0.6 MPa at an outlet, alkali used in the oxygen delignification treatment being 2-4% of bone dry pulp based on sodium hydroxide, and oxygen added being 20-40 kg for every ton of bone dry pulp, and the pulp reacting in the reaction tower for 60-90 min;

(2) beating the unbleached straw pulp and an unbleached wood pulp respectively to obtain beaten pulps;

(3) mixing the beaten unbleached straw pulp and the beaten unbleached wood pulp in step (2) based on parts by weight as required by the paper product, and blending the pulp even; and (4) manufacturing with the beaten pulps to obtain the unbleached paper product, wherein the cooking is a basic sodium sulfite cooking method in a vertical cooker, comprising:

1) adding cooking liquor to the cereal straw material, in which sodium hydroxide is 9-17% of the bone dry raw material by weight, sodium sulfite used is 4-8%, anthraquinone is 0.04-0.08% and a cooking liquor ratio is 1:6-10; and 2) filling the cereal straw material in hot black liquor in the cooker by a charger, closing a cooker cover after the cooker is full, supplementing the cooking liquor at 145° C. while discharging air from the cooker and boosting to a pressure of 0.45-0.6 MPa, and heating the cooking liquor to 152-165° C. in which time for heating, insulating and exchanging is 180-220 min; and pumping the pulp to a blow tank.

6. The method for preparing the unbleached paper product according to claim 5, wherein the cooking step comprises obtaining a pulp with a potassium permanganate number of 16-28 and beating degree of 10-24° SR after cooking cereal straw plants as the raw material.

7. The method for preparing the unbleached paper product according to claim 6, wherein the unbleached straw pulp is a pulp with a potassium permanganate number of 16-23 and beating degree of 10-24° SR after cooking grass plants as the raw material.

8. The method for preparing the unbleached paper product according to claim 5, wherein the disintegration comprises:

treating the pulp obtained after washing by deflaker, rubbing machine, disc crusher, disc refiner or defibering machine of beating machine, to loosen the fiber.

9. A method for preparing an unbleached paper product prepared from cereal straw pulp as a raw material, wherein the method comprises:

preparing the cereal straw material before cooking, including:

cutting and rubbing the cereal straw material to obtain a cut and rubbed material;

dedusting the cut and rubbed material; and screening the dedusted material;

(1) cooking the cereal straw material, pressing, washing, disintegration and then performing oxygen delignification treatment to obtain an unbleached straw pulp;

wherein the oxygen delignification includes:

pumping pulp with a potassium permanganate number of 16-28 obtained after cooking to an oxygen delignification reaction tower and adding sodium hydroxide and oxygen; and allowing delignification reaction of the pulp in an oxygen delignification reaction tower to obtain pulp with a hardness having a potassium permanganate number of 10-14;

the oxygen delignification being single stage and executed in the oxygen delignification reaction tower, the pulp being at 95-100° C. and a pressure of 0.9-1.2 MPa at an inlet of the reaction tower and at 100-105° C. and a pressure of 0.2-0.6 MPa at an outlet, alkali used in the oxygen delignification treatment being 2-4% of bone dry pulp based on sodium hydroxide, and oxygen added being 20-40 kg for every ton of bone dry pulp, and the pulp reacting in the reaction tower for 60-90 min;

(2) beating the unbleached straw pulp and an unbleached wood pulp respectively to obtain beaten pulps;

(3) mixing the beaten unbleached straw pulp and the beaten unbleached wood pulp in step (2) based on parts by weight as required by the paper product, and blending the pulp even; and (4) manufacturing with the beaten pulps to obtain the unbleached paper product, wherein the cooking is a sulfate cooking method in a vertical cooler comprising:

1) adding cooking liquor to the cereal straw material, in which alkali used is 8-13% of the bone dry raw material based on sodium hydroxide, liquor ratio is 1:6-10, and sulfidity is 5-9%; and 2) filling the cereal straw material in hot black liquor in the cooker by a charger, closing a cooker cover after the cooker is full, supplementing the cooking liquor at 130-145° C. while discharging air from the cooker and boosting a pressure to 0.5-0.65 MPa, and heating the cooking liquor to 155-168° C. in which a time for heating, insulating and exchanging is 180-220 min; and pumping the pulp to a blow tank.

10. The method for preparing the unbleached paper product according to claim 9, wherein the cooking step comprises obtaining a pulp with a potassium permanganate number of 16-28 and beating degree of 10-24° SR after cooking cereal straw plants as the raw material.

11. The method for preparing the unbleached paper product according to claim 10, wherein the unbleached straw pulp is a pulp with a potassium permanganate number of 16-23 and beating degree of 10-24° SR after cooking cereal straw as the raw material.

12. The method for preparing the unbleached paper product according to claim 9, wherein the disintegration comprises:

treating the pulp obtained after washing by deflaker, rubbing machine, disc crusher, disc refiner or defibering machine of beating machine, to loosen the fiber.

* * * * *